US007350740B2

(12) United States Patent
Benvenuti et al.

(10) Patent No.: US 7,350,740 B2
(45) Date of Patent: Apr. 1, 2008

(54) AUTOMATIC AND CONTINUOUS UNWINDER DEVICE FOR SUPPLYING WEB-LIKE MATERIAL FROM REELS

(75) Inventors: Angelo Benvenuti, Lucca (IT); Roberto Morelli, Lucca (IT); Romano Maddaleni, Pisa (IT)

(73) Assignee: Fabio Perini S.p.A., Lucca (IT)

( * ) Notice: Subject to any disclaimer, the term of this patent is extended or adjusted under 35 U.S.C. 154(b) by 373 days.

(21) Appl. No.: 10/548,831

(22) PCT Filed: Feb. 27, 2004

(86) PCT No.: PCT/IT2004/000090

§ 371 (c)(1),
(2), (4) Date: Sep. 13, 2005

(87) PCT Pub. No.: WO2004/080867

PCT Pub. Date: Sep. 23, 2004

(65) Prior Publication Data

US 2006/0175457 A1 Aug. 10, 2006

(30) Foreign Application Priority Data

Mar. 13, 2003 (IT) ..... FI2003A0064

(51) Int. Cl.
*B65H 19/12* (2006.01)
*B65H 19/18* (2006.01)

(52) U.S. Cl. ..... 242/555.1; 242/559; 242/555.3

(58) Field of Classification Search ..... 242/551, 242/552, 554, 554.2, 559, 555.3, 555.1, 555.7, 242/555, 555.5, 556, 558
See application file for complete search history.

(56) References Cited

U.S. PATENT DOCUMENTS

| | | | | |
|---|---|---|---|---|
| 3,460,775 | A * | 8/1969 | Bassett et al. | 242/555.6 |
| 4,544,109 | A | 10/1985 | Andreásson | |
| 5,730,389 | A | 3/1998 | Biagiotti | |
| 5,762,283 | A | 6/1998 | Buchmeyer et al. | |
| 5,906,333 | A | 5/1999 | Fortuna et al. | |
| 6,030,496 | A | 2/2000 | Baggot et al. | |
| 2003/0173450 | A1 | 9/2003 | Suzuki et al. | |

FOREIGN PATENT DOCUMENTS

| | | |
|---|---|---|
| DE | 43 34 582 A1 | 4/1995 |
| DE | 100 02 686 A1 | 8/2001 |
| EP | 0 872 440 A2 | 10/1998 |
| EP | 1 136 406 A2 | 9/2001 |
| EP | 1 162 164 A1 | 12/2001 |

(Continued)

*Primary Examiner*—Peter M. Cuomo
*Assistant Examiner*—William E Dondero
(74) *Attorney, Agent, or Firm*—Breiner & Breiner, L.L.C.

(57) ABSTRACT

The unwinder device includes an unwinding station (7), with unwinding members for unwinding reels and a splicing device (151) for splicing together web-like materials (N1 and N2) coming from a first reel (B1) and from a second reel (B2). At least two supports (49, 51) are arranged in the unwinding station for the respective reels of web-like material, associated with respective unwinding members (83, 99). The supports are constructed and arranged to simultaneously support two reels being unwound, during at least a phase of the unwinding, and each of said supports is able and constructed to load a new reel in an engagement position, support it during the unwinding and unload it in a release position.

55 Claims, 18 Drawing Sheets

FOREIGN PATENT DOCUMENTS

| | | |
|---|---|---|
| EP | 1 270 470 A2 | 1/2003 |
| GB | 1 389 651 | 4/1975 |
| WO | WO 95/34497 A1 | 12/1995 |
| WO | WO 98/46509 | 10/1998 |
| WO | WO 00/56644 A1 | 9/2000 |

* cited by examiner

II
II
7
43
151
N1
161
55
59
73
141
171
181
179
153
159
24
23
26
9
61
65
89
99
51
175
177
93
B-B
137
101
79
A-A
19=21
15
11
139
f131
B1
49
110
115
117
125
114
113
116
10
12
45
112
112A
60
111
69
119
121
53
57
41
123
B0
135
131
f133
133

7
43
45
55
59
57
53
131
133
137
139
141
73
61
51
65
89
93
99
101
79
BB
AA
115
117
114
112
110
125
B-B
A-A
B1
N1
151
161
171
181
179
173
175
177
153
24
23
26
159
19=21
15
9
11
10
12
113
116
49
60
69
41
119
123
121
135

7
43
55
59
73
171
181
179
151
161
153
24
23
26
175
177
61
65
N1
159
19=21
89
99
93
51
101
137
139
141
B-B
A-A
79
B1
15
9
11
10
12
45
131
110
115
117
60
111
113
116
119
121
123
135
133
41
114
112
125
69
49
57
53

43
55
59
61
141
N1
171
161
153
N2
24
23
175
51
99
9
137
B1
B2
139
93
89
101
79
19=21
15
10
11
45
49
115
125
117
113
116
60
73
41
114
112
110
111
119
123
121
131
53
57
133
135

IV 17A
33
31
27=29
25
35
19
24
23
26
19
15
10
11
B1
15
10
9
12
IV

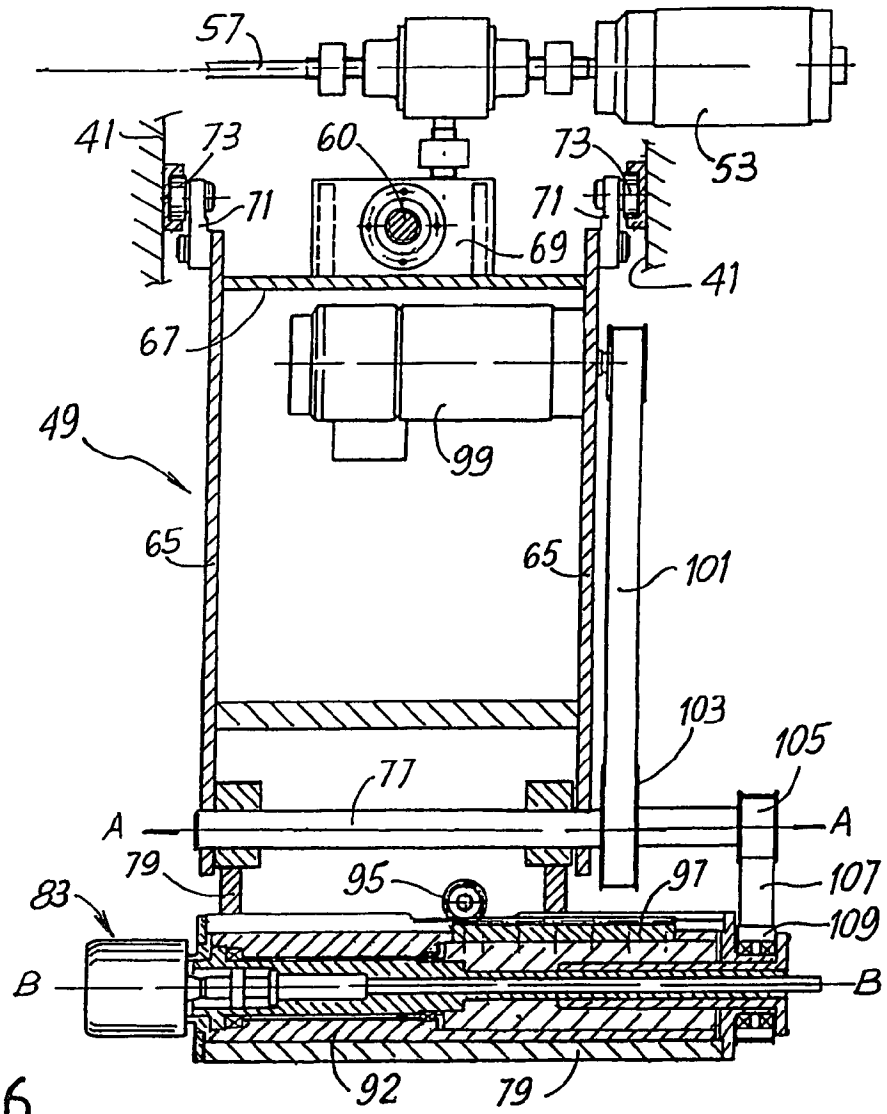
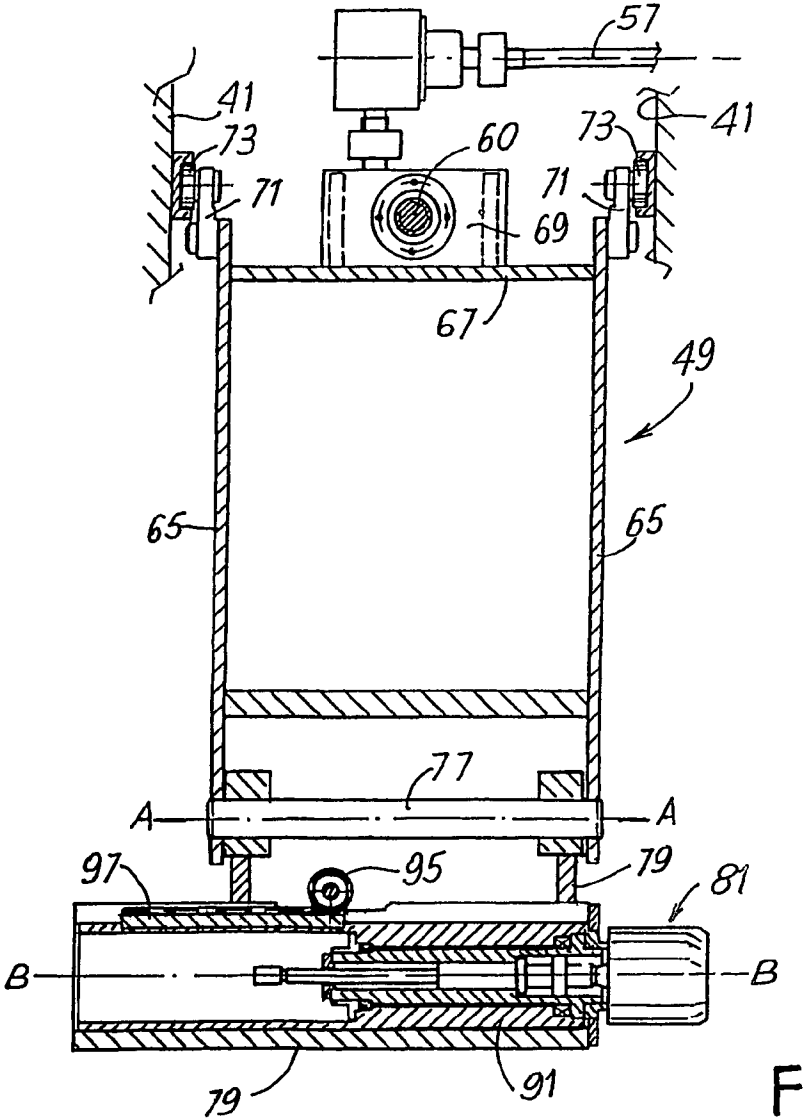
Fig. 6

AUTOMATIC AND CONTINUOUS UNWINDER DEVICE FOR SUPPLYING WEB-LIKE MATERIAL FROM REELS

TECHNICAL FIELD

This invention concerns an unwinder device for unwinding reels of web-like material wound around a central spindle for supplying web-like material to a converting or processing line.

The invention also concerns a method for unwinding reels of web-like material and for feeding the unwound material to a converting or processing line.

STATE OF THE ART

In many industrial applications, there is a requirement to feed a production line with a web-like material that is unwound from a reel or multiple reels in parallel. Typically, the feeding of web-like material is requested in the paper industry. For example, for the production of paper serviettes, rolls of toilet paper, kitchen rolls or the like, converting lines are provided in which a web-like material is supplied from a reel of large diameter and very long axial length to a series of stations downstream, at the end of which the finished product is obtained. In the case of rolls of toilet paper and similar products, the web-like material is supplied from one or more large-diameter mother reels and wound onto rolls or logs of smaller diameter, which are successively cut orthogonally to their own axis to obtain the finished rolls. In certain cases, the web-like material supplied by the large-diameter reel or reels is cut longitudinally to form in parallel a number of rolls of minor height, i.e. of minor axial length.

In the case of serviette production, web-like material is fed from one or more large-diameter reels that, cut in longitudinal strips if necessary, is folded longitudinally, cut, and folded transversely.

The production of rolls, serviettes or other articles is performed at high speed and in a continuous manner, requiring the periodic substitution of the large-diameter reels as they run out. In many case, it is necessary to stop the production line or at least drastically reduce the speed thereof, to allow the empty reels to be replaced by new reels. This operation reduces the overall productivity of the line with evident economic damage. There is therefore a need to provide unwinder devices that permit a rapid and reliable substitution of empty reels with new reels. These devices must also handle the splicing, that is the joining, of the web-like materials coming from consecutive reels. The purpose of this is to obtain a substantial continuity in the supply of the web-like material to the downstream production line. The web-like portion containing the splice is normally discarded. When the line produces rolls, the splicing portion will end up on a roll or log that is subsequently discarded and recycled.

In WO-A-9534497 an unwinder device is describes that permits the automatic, rapid and reliable splicing of two web-like materials coming respectively from an empty reel and a new reel in substitution. On this device, a shuttle or carriage is provided that travels between a loading station and an unwinding station, each time to transfer a reel from the loading station to the unwinding station and to remove the empty tubular core from the unwinding zone to an unloading zone. Means are provided on the shuttle for the preparation and restraint of the free leading edge of web-like material wound on the reel loaded on the shuttle itself. In the unwinding station, a cutting member and a retainer member are provided that serve to produce a free tail edge on the web-like material supplied from the previous supplying reel and to retain this free edge for subsequently producing the splicing with the free leading edge of web-like material on the reel inserted in the unwinding station by the shuttle.

To perform the substitution of the empty reel with a new reel it is therefore necessary to stop the supply of web-like material, even though the splicing operation is rendered particularly rapid by the innovative arrangement of the cutting and splicing means described in this publication.

In WO-A-0056644 another unwinder device is described that can use the same type of mechanism for the splicing two web-like materials coming from two successive reels. In this case as well, the substitution of the reels takes place after halting the feeding of web-like material to the downstream production line. Although it is possible to provide a certain accumulation of web-like material from the unwinder to the production line, via a festoon accumulator for example, this is hot always suitable due to the characteristics of the web-like material, which may not be particularly resistant to traction, or due, to the high speed of the production line, which would require an excessively large accumulator. In addition, the tortuous path defined by the festoon can cause the detachment of fibres from the web-like material, especially when this is made of tissue paper, with the consequent production of dust and a diminishment in the characteristics of the finished product.

In EP-A-1136406 an unwinder with a shuttle that transfers the reels from one or the other of two loading and unloading positions to an intermediate unwinding position is described. The shuttle has a motorized tailstock for unwinding the reel. The substitution of an empty reel with a new reel requires halting the feed.

Studies have been made for the realization of an unwinder that permits the automatic and continuous substitution of the reels, i.e. without halting the supply of the web-like material to the converting or production line downstream of the unwinder. Examples of unwinders that should operate continuously are described in U.S. Pat. No. 5,906,333, U.S. Pat. No. 6,030,496, EP-A-1,270,470, EP-A-0872440 and WO-A-9846509. In these publications, an unwinder is described in which the reel is supported by a pair of oscillating arms in the supply phase. When the reel is nearly empty, the arms deposit it on a cradle formed by two rollers, one of which is motorized, to continue the rotation of the reel and thus the supply of the web-like material. Successively, the pair of oscillating arms pick up a new reel from a shuttle and starts to unwind -the leading edge with the aid of a suction belt. The free leading edge of the new reel is made to fall on top of the web-like material being unwound on the first reel, at this point nearly empty. The contact between the two web-like materials should provoke the transport of the free leading edge of web-like material wound around the second reel and its feeding together with first web-like material until a nip formed by two embossing or laminating cylinders is reached, which should splice the two webs together.

The operation of this unwinder, device is extremely insecure as precisely in the initial, and most critical, phase of feeding the new web-like material its transport is entrusted to the simple contact between two extremely light materials. Nothing guarantees that the web-like material coming from the new reel effectively follows the path defined by the first web-like material coming from the reel that is running out. In addition, since the splicing of the two layers must occur when they have the same feed speeds, it is necessary to arrange the cylinders that perform the splicing at a considerable distance from the reel unwinding zone.

In fact, the amount of web-like material unwound by the new reel in the acceleration phase until the speed reached is the same as that of the material coming from the first reel is considerable. The distance between the reel and the splicing cylinders must be at least equal to the length of the web-like material unwound in this phase of acceleration. The position of the cylinders that perform the splicing of the two web-like materials must be situated at the point in which the head of the second web-like material finds itself at the moment of splicing and not further back, because otherwise the head of the web-like material will remain free and will accidentally wrap itself around one of the rollers of the production line with the consequent jamming of the entire production line.

OBJECTS AND SUMMARY OF THE INVENTION

In accordance with a first aspect, the object of this invention is to provide an unwinder device that permits the substitution of an empty reel with a new reel of web-like material in a rapid and reliable manner, without significantly slowing the feed speed of the web-like material itself to the production line downstream of the unwinder, and in any case without halting the feeding.

This, and other objects and advantages, which will appear clear to those expert in the field from reading the text that follows, are essentially achieved with an unwinder device of the type including an unwinding station, with unwinding members for unwinding the reels and a splicing device for splicing together the web-like materials coming from reels driven in sequence. Characteristically, in accordance with the invention, two supports are arranged in the unwinding station for two respective reels of web-like material, associated with unwinding members. The supports are constructed and arranged to simultaneously support two reels being unwound, during at least one phase of unwinding, and each one is mobile from an engagement position for a new reel to a release position for an empty reel. Each support is controlled and arranged such that it can receive a reel in a loading position, maintain it in a main unwinding-position and transfer it to an unloading zone, separate from the loading zone, where it is removed.

In this way, it is possible to initiate the rotation of a new reel before a reel that is running out is completely empty. When the peripheral speeds of the due reels, and thus of the two web-like materials are the sane or substantially the same; the two web-like materials are spliced to obtain a continuous feed of material to the downstream production line. In this way, continuous operation is achieved, with a consequent increase in production rate, and with a high level of operational reliability.

The reels can be inserted on the unwinding station via a shuttle that moves parallel to the axis of the reels from a loading station to the unwinding station, the two stations being situated side by side. Unlike usual unwinder devices, the device in accordance with the invention does not require a two-position shuttle and two loading and unloading stations on opposite sides of the intermediate unwinding station. In fact, once the reel has been passed from the shuttle to the respective support, the shuttle can leave the unwinding station and pick up a new reel, which will subsequently be passed to the other of the two supports. The shuttle, unlike usual devices, is not equipped with supports that hold the reel during unwinding. This function is integrally transferred to the two supports of the unwinding station, which do not move to and from the loading station at the side of the unwinding station. This permits the space occupied by the production line in which the unwinder device is inserted to be, significantly reduced.

The supports for the reels can each be formed by a single arm, or by a pair of arms, depending on the dimensions and weight of the reels. The arms can be mobile with an oscillating or, preferable traverse, movement from the engagement position to the release position of the reels.

In a possible and advantageous embodiment, the unwinding members and the supports are controlled in a manner such that while the unwinding members associated with a first of said two supports keeps a first reel in rotation in the supply phase, a second reel is engaged by a second of said supports and made to rotate.

Since the new reel is advantageously made to rotate before performing the splicing of the respective web-like material with the web-like material coming from the reel that is running out, for the purpose of simplifying the running operations of the device, at least one accumulator member could be provided for accumulating the web-like material supplied by said second reel prior to splicing it to the material coming from the reel that is running out.

The accumulator member can limit itself to receiving the web-like material and holding it, cutting it after splicing is performed, so that the initial portion of the web-like material of each reel is then recouped by extracting it from the accumulator member. However, in a preferred embodiment of the invention, the accumulator member is reversible, in the sense that the web-like material temporarily accumulated during the splicing phase of the two web-like materials coming from the two reels can be fed, after splicing, to the production line, from where it can be discarded together with the portion containing the splice.

The accumulator member can be carried by the shuttle or can be arranged in a fixed position on the unwinding station. In the first case, a system that requires the operator to anchor the free leading edge of the web-like material could be adopted for the accumulator member. This is because this operation can be performed in total safety when the shuttle is at the loading station. In the second case, the accumulator member can, for example, be a suction member, which does not require the coupling or fixing of the free leading edge of the web-like material.

In a possible and advantageous embodiment of the unwinder device, for each of the reel supports provided in the,unwinding station there are associated unwinding members including, for each support, a central unwinding member, which supplies the rotary motion to the respective reel. The central unwinding member can be formed, for example, by a spindle or motorized tailstock that engages in a hole of a tubular core around which the reel is formed. In general, the term central unwinding member is intended as an unwinder that provides the unwinding motion through the spindle of the reel.

Alternatively, for each of the reel supports in the unwinding station there could be an associated surface unwinding member, comprising, for example, one or two unwinding rollers carried by said supports and held in contact with the respective reel. As an alternative, unwinding members could be provided that act on the frontal surface of the reel, or combinations of different types of unwinders.

For the object of achieving optimal unwinding even of reels of large diameter and/or with modest winding density, that is to say soft reels, a surface unwinding member, which could act on the surface of the reel, carried on one or the other of the two supports without distinction, could be provided to advantage in the unwinding station. With a device of this type, each reel is unwound for the greater part of its length by the surface unwinding member, and only when it reaches a reduced diameter will unwinding continue via the unwinding member, preferably of a central type, associated with the respective support. The surface unwinding member can also be used to advantage in the initial acceleration phase of the reel before the two web-like -materials are spliced.

In certain situations, it may be useful for the surface unwinding member to act on the reel being unwound in combination and in a coordinated manner with the unwinding member associated with the respective support. This is particularly appropriate when the reel being unwound has a low winding density, because in this case there is the risk that the unwinding torque applied exclusively via the surface unwinding member could provoke reciprocal slippage of the turns of the material wound on the reel. To avoid this happening, it could be advantageous to provide for the unwinding torque to be supplied by the combined effect of the surface unwinding member and the central unwinding member associated with the support of the reel.

The term surface unwinding member means any kind of system that applies rotational torque to the reels via a frictional force applied to its outer cylindrical surface. It can be composed of one or more motorized rollers or, preferable, by one or more belts held in contact with the cylindrical surface of the reel. Surface unwinders of this type are known to the experts in this field.

In principle, it would also be possible to provide two surface unwinding members, associated with the two supports for the reels, but in accordance with a preferred embodiment of the invention, a single surface unwinding member is provided, for reasons of cost, bulk, and simplicity of construction and operation.

To simplify the transfer of the reels from the loading station or stations to the unwinding station, it is advantageous to ensure that both supports for the reels are always brought in the same engagement position. In this way, each reel must always be transferred from the shuttle to the same position inside the unwinding station, independently of which of the two supports is destined to engage it. For this purpose, the supports are advantageously provided with a variable geometry, to avoid collision between the supports when they change position in the phase of substituting an empty reel with a new reel. The geometrical configuration is changed when the support passes from the release position of an empty reel to the engagement position of a new reel.

The supports can each include one or two arms, including a main body and an end that is mobile with respect to the main body and carrying a gripper device for the reel. The mobility of the end carrying the gripper device confers the possibility of changing the geometric set-up of the support. For example, the end carrying the gripper device can provided with a translational motion or can be telescopically extensible. In a preferred and particularly simple embodiment, the movement is an oscillatory motion around an axis integral with the body of the respective arm. The gripper device can be composed of a spindle or tailstock that is inserted into the axial hole of a winding core, or a chuck that externally grips an axial shaft of the reel. The possibility of the gripper device having a different configuration is not excluded, for example it could be composed of a jaw that grips an idling support running onto a shaft or spindle of the reel.

When the gripper devices consist of spindles or tailstocks it is advantageous for them to be provided with an axial movement of insertion and extraction from the reel.

To simplify the insertion operations of new reels of web-like material in the unwinding station when the previous reel is still in the supply phase, a deviator member could be provided to advantage in said unwinding station, which deviates the path of the web-like material supplied by the reel that is nearly empty to allow the insertion of a new reel in the unwinding station-without impediment.

In order to prepare the free leading edge of a new reel while the shuttle is at least partially outside of unwinding station, said shuttle may include at least a retainer member for the free leading edge of the web-like material of a reel placed on said shuttle. Advantageously, in the unwinding station a guide roll can be provided for the web-like material in the supply phase. In order to avoid this hindering the insertion of new reels carried by the shuttle; the latter can be provided with members that define a path for free leading edge of web-like material, extending from the retainer member to the reel, which passes over the position of the axis of said guide roll.

In accordance with a second aspect, the object of this invention is to provide a method of feeding a web-like material to a downstream production line that permits the rapid and reliable substitution of empty reels with new reels of web-like material, so as to ensure substantially continuous production on the line downstream of the unwinder.

This object is achieved with a method comprising the following phases:

- arranging a first reel in an unwinding station,
- engaging the first reel on a first support associated with first unwinding members,
- supplying a first web-like material from the first reel to the processing line,
- placing a second reel with a second web-like material in said unwinding station,
- engaging the second reel on a second support associated with second unwinding members,
- making the second reel rotate, unwinding an initial portion of the second web-like material from it,
- splicing the first and the second web-like materials together when the speeds of the two web-like materials are substantially the same.

Further advantageous characteristics and embodiment of the method and the device in accordance with the invention are indicated in the attached claims and will be described in the following with reference to a specific example of embodiment.

BRIEF DESCRIPTION OF DRAWINGS

The invention will be better understood following the description and the enclosed drawings, which illustrates a practical, non-limitative embodiment of the invention. In particular, in the drawings:

FIGS. 1A-1K show side views of the unwinding station in a series of successive positions during reel changing, FIG. 6 shows a sectional view along VI-VI of FIG. 5B of one of the means of support of the reel.

DETAILED DESCRIPTION OF THE PREFERRED EMBODIMENTS OF THE INVENTION

Figure 1A:
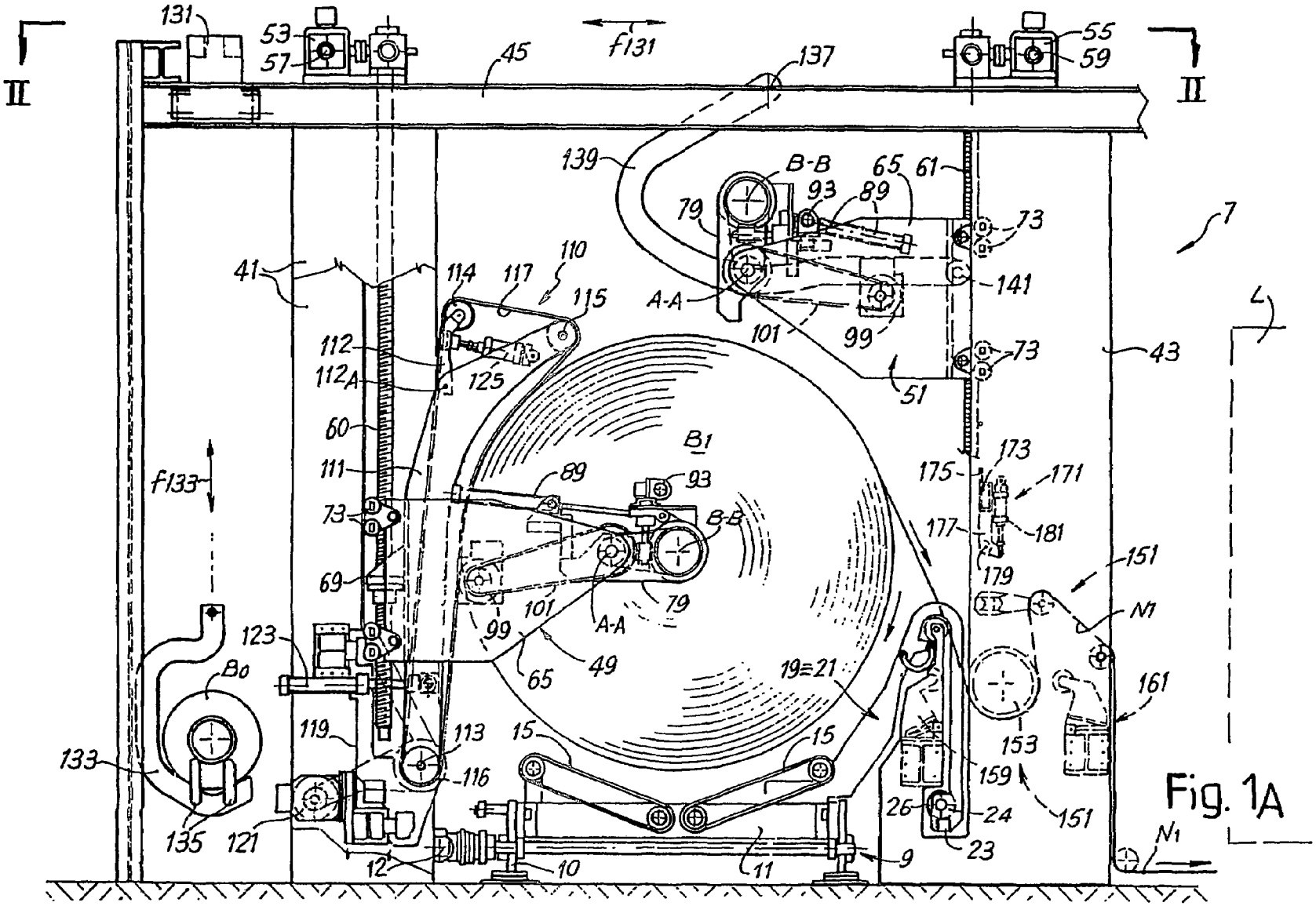

The unwinder device in accordance with the invention, generically indicated by reference 1, in the illustrated example includes a loading station 3 arranged at the side of an unwinding station 7. A shuttle or carriage 9 (see FIG. 2 in particular) is provided with reciprocating translatory motion in the directions of the double arrow f9 for moving between the loading station 3 and the unwinding station 7. With specific reference to the plan view in FIG. 2, by moving the shuttle 9 to the right it can transfer the reel B2 to the unwinding station 7.

Figure 3:
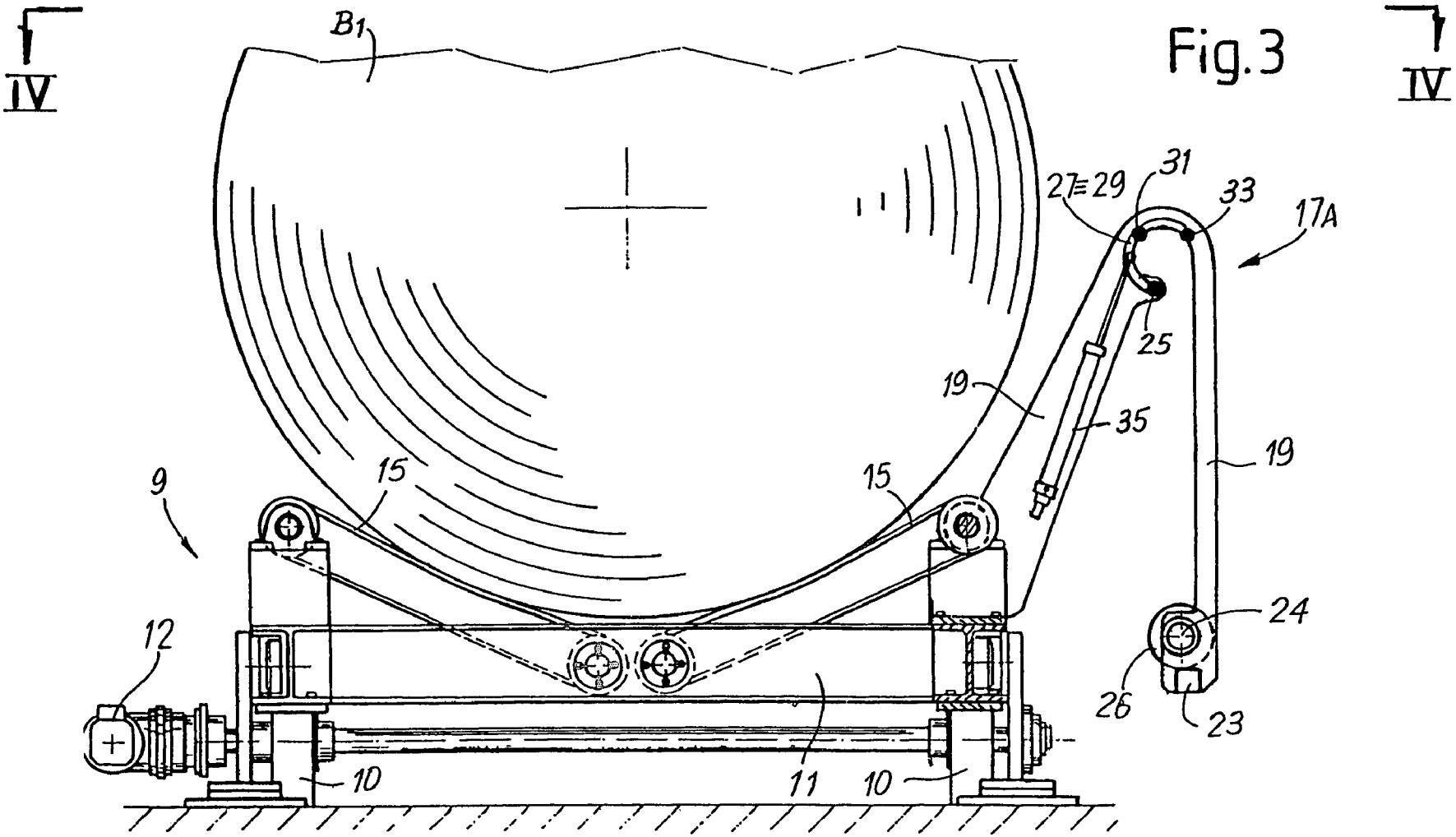
Figure 4:
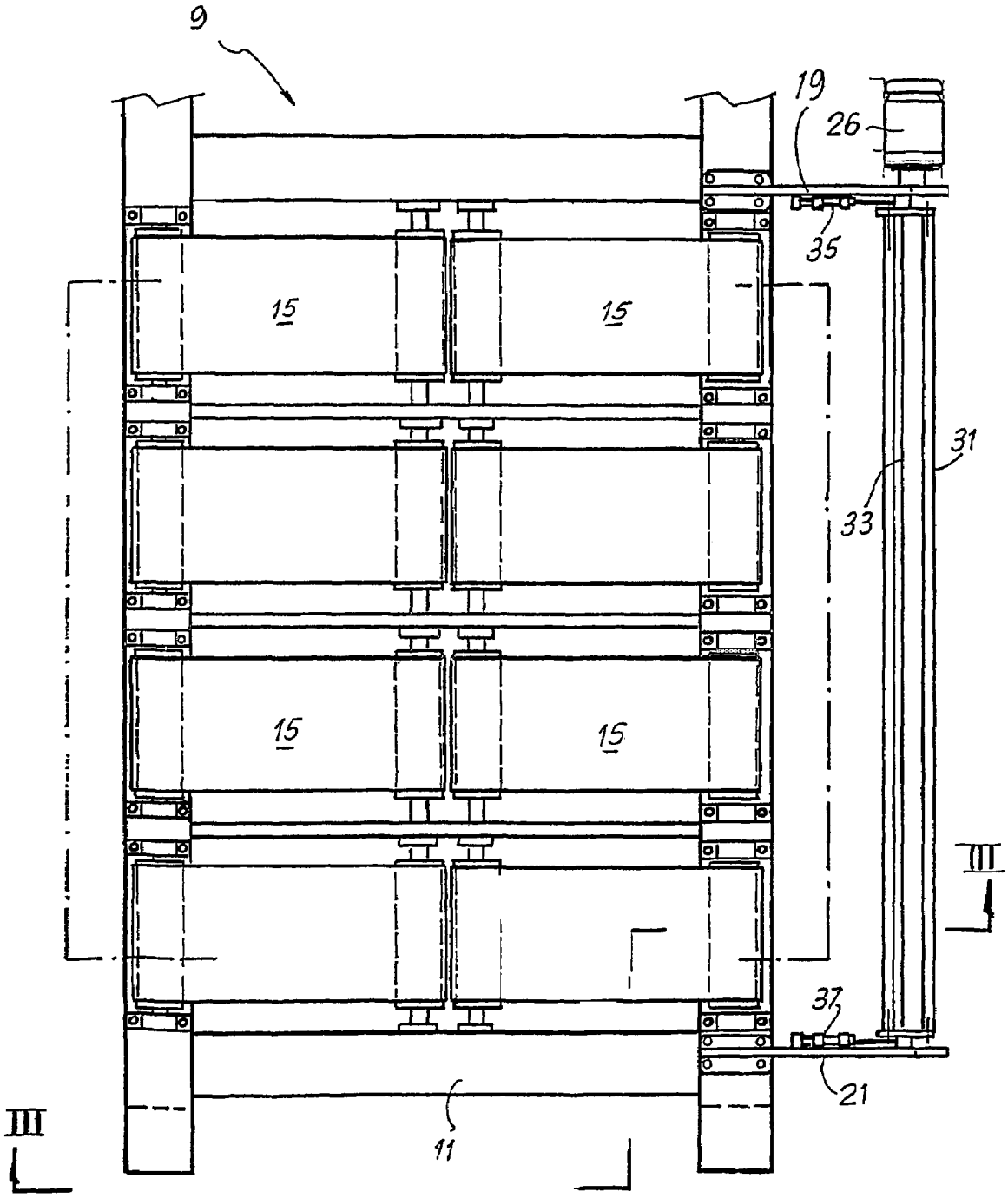
FIG. 4 shows a plan view along IV-IV of FIG. 3, FIGS. 5A and 5B show a lateral view one of the means of support for the reels in two different positions.
Figure 7B:
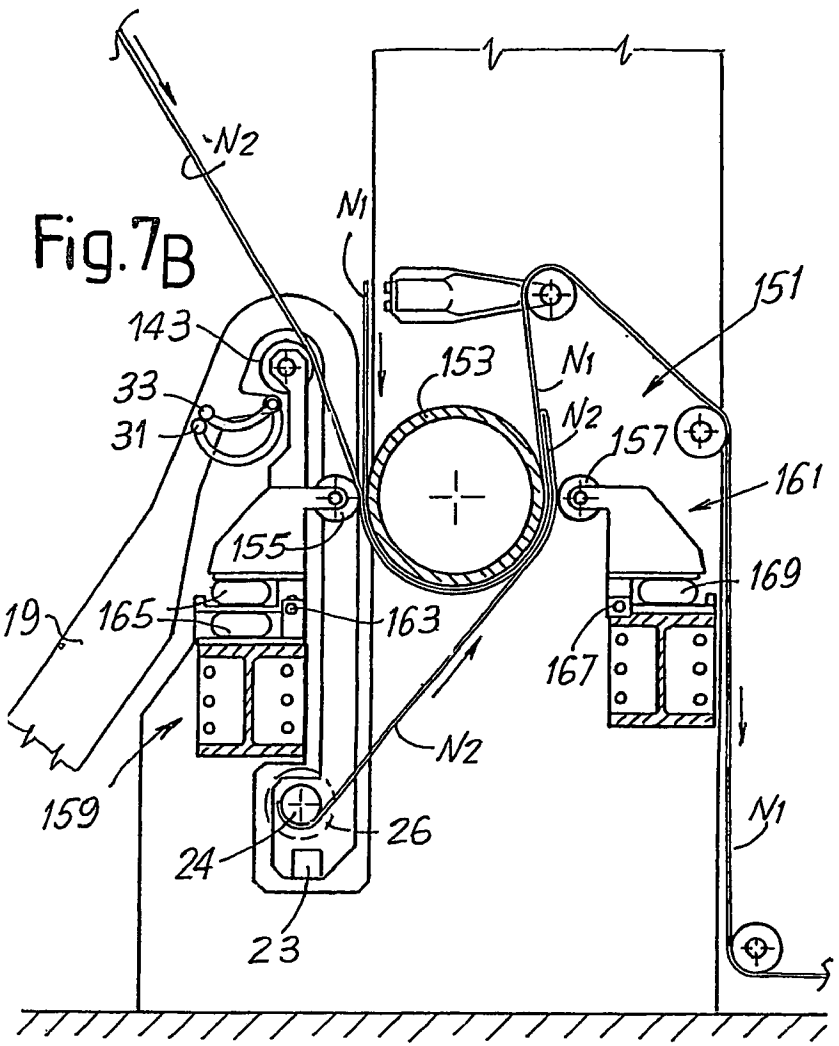
FIGS. 7A and 7B show an enlarged schematic lateral view of the splicing device and the accumulator member, in two different positions during splicing of the two web-like materials coming from the two reels.
Figure 7A:
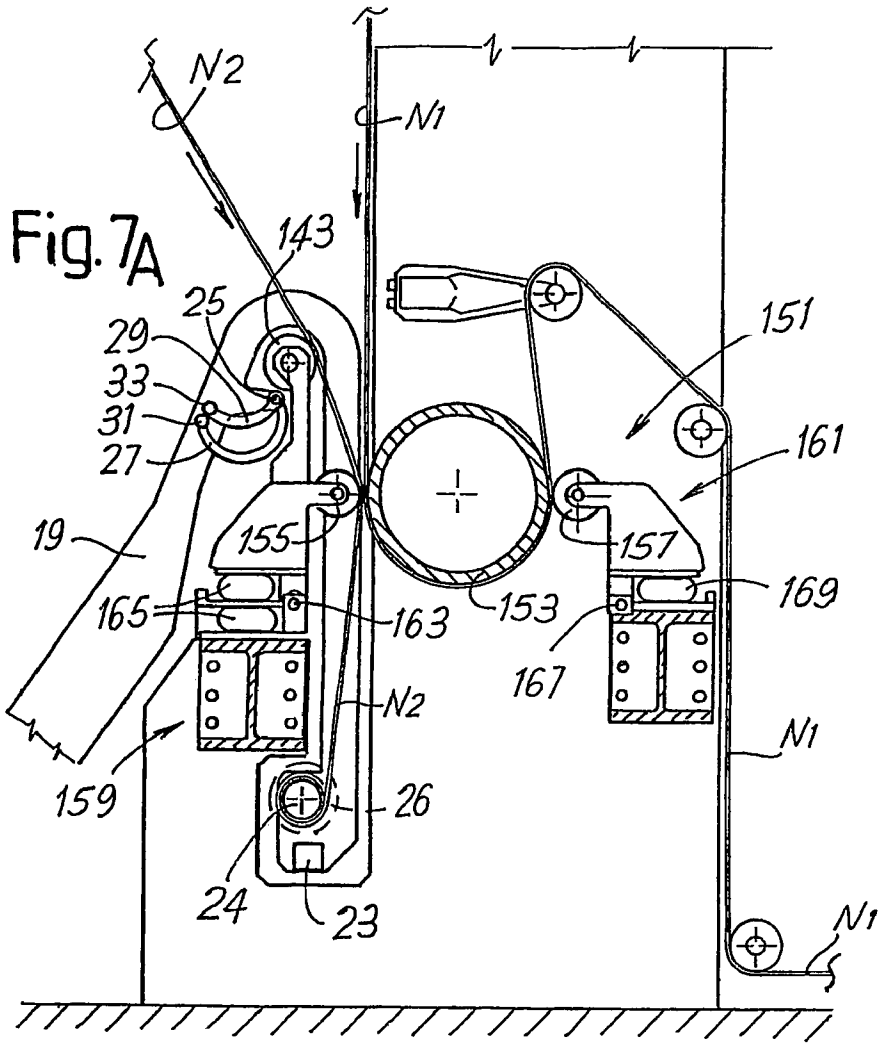

As can be seen in FIGS. 3 and 4 in particular, where the shuttle 9 is shown separately from the other members of the unwinder device, the shuttle has a structure or frame 11 equipped with wheels 10 driven by a motor 12 that provides motion in the directions of the double arrow f9. On the frame 11, support belts 15 with a V-shaped arrangement are provided to create a support cradle for the reels. Each reel placed on the shuttle 9 is oriented with its own axis parallel to the direction of movement of the shuttle 9 itself. A retainer member is associated with the support cradle for the free leading edge of every reel each time one is placed on the shuttle, this member indicated as a whole by reference 17 in FIG. 4. The retainer member 17 has a pair of sides rigidly bound to the structure or frame 11 of the carriage or shuttle 9, approximately shaped like an inverted V, and indicated by references 19 and 21. As can be seen in the enlargements of FIGS. 7A and 7B in particular, a bat 23 runs between the sides 19 and 21 parallel to the direction of movement of the shuttle 9 and which has an edge destined to facilitate the straight cutting of the leading edge of the web-like material wound on each reel placed onboard the trolley or shuttle 9.

The bar 23 is applied close to the lower ends of the respective, substantially vertical arms of the sides 19 and 21. These substantially vertical arms are connected at the top to an inclined arm integral with the frame 1 of the shuttle 9. In the zone of convergence, corresponding to the vertex of the inverted V, the two sides define an empty space for purposes that will be shortly become clear. A pivot axis 25 passes slightly below the zone of convergence of the two arms forming the sides 19 and 21, around which axis a pair of semicircular members 27 and 29 associated to each side 19 and 21 rotate. Rollers or rods 31 and 33 are constrained to each pair of semicircular members 27 or 29. Respective cylinder-piston actuators 35 and 37 are associated with the sides 19 and 21 for controlling the oscillation of the semicircular members 25 and 27 for purposes that will become clear in the following.

The vertical arms of the sides 19 and 21 carrying the bar 23 also support a suction roll 24, motorized via a motor 26, the purpose of which will be explained in the following in reference to the principle of operation of the unwinder device.

The unwinding station 7 (see FIG. 1A in particular) includes a pair of vertical uprights 41 and 43 joined by a horizontal tie beam 45. Inside this portal-like structure 41, 43 and 45, a space is delimited through which the shuttle 9 transits in its movement of transferring reels from the loading stations 3 and 5 to the unwinding station 7. Actually, each upright 41 and 43 is double, as can be seen in FIG. 2 in particular. Two arms, indicated as a whole by reference 49, slide vertically on the double upright 41, defining a first support for a first reel in the unwinding position in the station 7. The two arms 49 are shown separately in the enlargement in FIG. 6 and will be described in greater detail further on. A similar pair of arms S1 is vertically mobile along the double upright 43 and defines a second support for a second reel inside the unwinding station 7. The raising and lowering movement of each pair of arms 49 and 51 is driven by respective motors 53 and 55, via horizontal shafts 57 and 59. The shafts 57 and 59 transmit the drive via angle transmissions and auxiliary shafts, each to a pair of vertical threaded rods 60 for the arms 49 and 61 for the arms 51 (see FIG. 2 in particular).

Figure 5A:
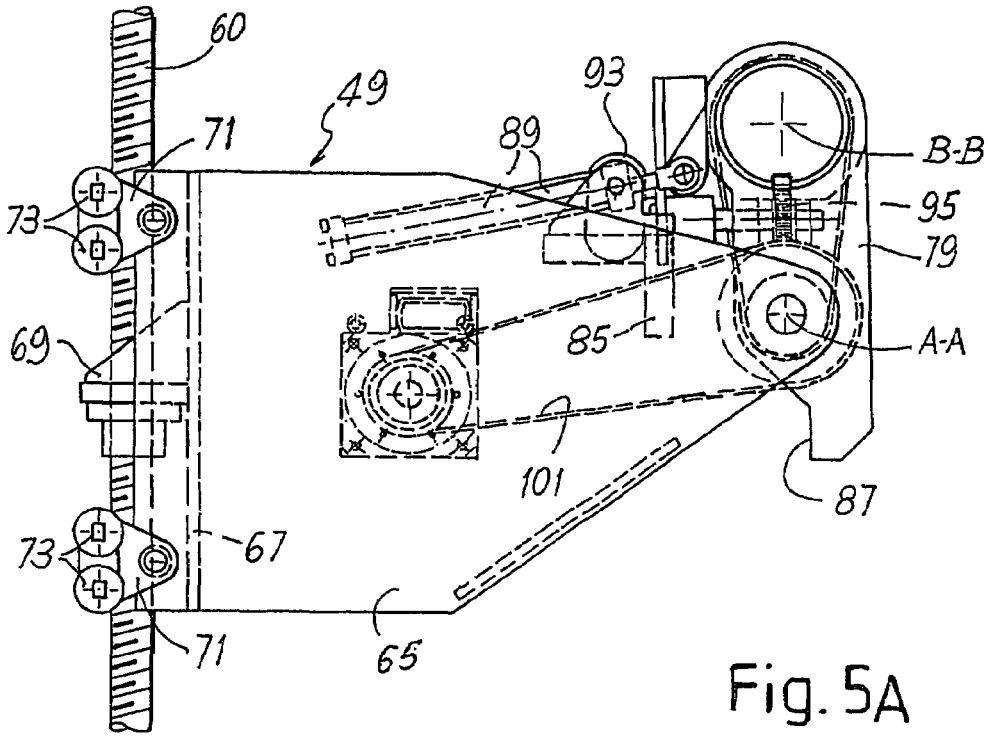
Figure 5B:
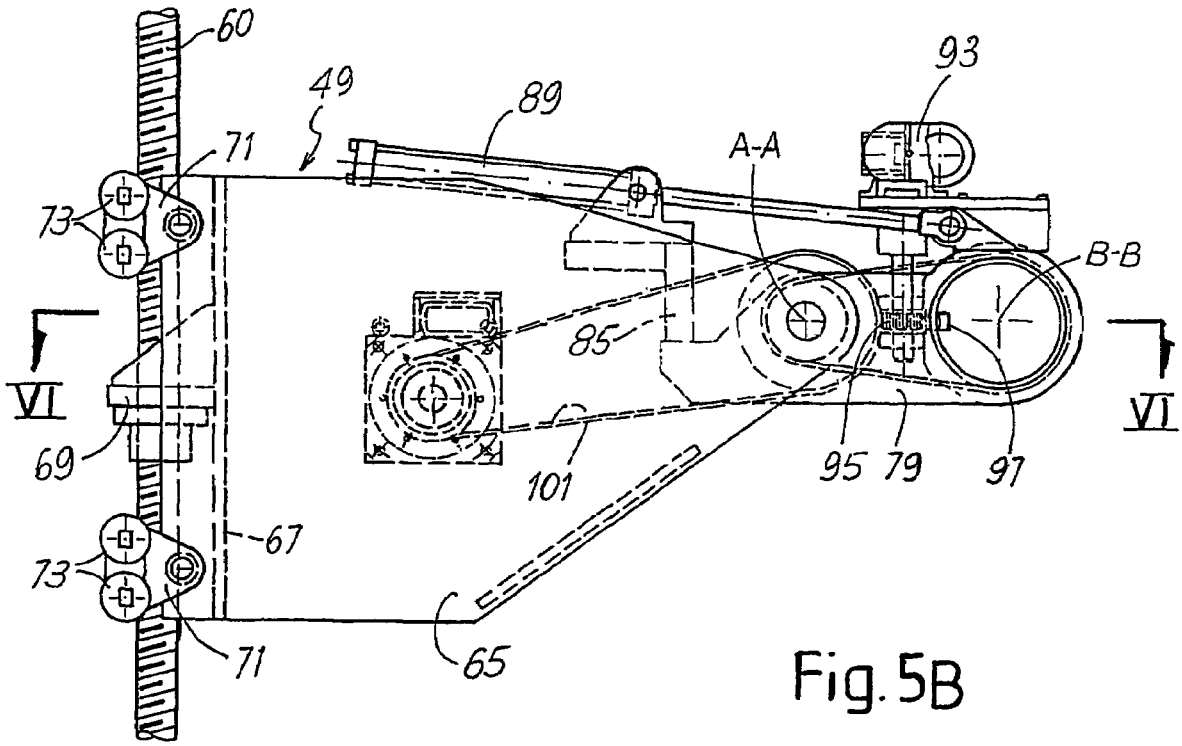

The arms 49 are substantially identical to the arms 51 and therefore only the arms 49 will be described in reference to FIG. 6. Each of said arms has a pair of sides 65 constrained by a cross beam 67 that carries la nut screw 69 engaged on the respective threaded rod 59. The sides 65 are integral with support plates 71 (see FIG. 5A and FIG. 5B) carrying guide rolls 73 along the uprights 41. As can be seen in FIG. 6 in particular, at the opposite ends of the sides 65 with respect to the position of the rolls 73, shafts 77 are provided for each arm 49, with horizontal axes A-A around which the groups 79 oscillate, each of which carries a respective spindle or tailstock 81, 83. The spindle-carrier or tail-stock-carrier groups 79 can assume two positions, shown in FIGS. 5A and 5B. In the position shown in FIG. 5A, the axis of the tailstocks 81 and 83, indicated by B-B and parallel to the oscillation axis A-A of the tailstock-carrier groups 79, is above the oscillation axis A-A. Conversely, in FIG. 5B, the axes B-B and A-A are aligned on a horizontal plane. This position is defined by a fixed stop 85 integral with the sides 65 and by a mobile stop 87 integral with the respective tailstock-carrier group 79. The oscillating movement of the tailstock-carrier groups 79 is controlled by a respective cylinder-piston actuator 89 carried by each arm 49 (FIGS. 5A and 5B).

As can be seen in the cross section of FIG. 6 in particular, the tailstock 81 is freely mounted on a sleeve 91 sliding inside the tailstock-carrier 79 and the translatory motion of which along the axis B-B of the tailstock itself is driven by a motor 93 via a rack and pinion transmission 95 and 97. A similar arrangement, indicated with the same reference numbers, is provided for driving the translatory motion of the sleeve 92 of the tailstock 83 along its own axis. However, to the contrary of tailstock 81, the tailstock 83 is not idle, but driven in rotation around its own axis by a motor 99 and transmission including a first belt 101, a pulley 103 on the A-A axis, a second pulley 105, a second belt 107 and a pulley 109 fitted on the axis of the tailstock 83.

Between the two elements forming the double upright 41, a surface unwinding member, indicated as a whole by reference 110, is arranged for the purpose (as will be described in greater detail further on), of unwinding the reels of web-like material for a significant part of the unwinding cycle, possibly in combination with the central unwinding members associated with the two reel support arms. The surface unwinding member 110 includes oscillating arms 111 hinged around a horizontal axis 113 parallel to the direction of translation of the shuttle 9. The surface unwinding member 110 is substantially removed from the view in FIG. 2 for drawing clarity, but is clearly illustrated in FIGS. 1A-1K. The pair of oscillating arms 111 carries three rolls 114, 115 and 116 with parallel axes that are also parallel to the axis of oscillation 113 of the arms 111, around which belts 117 are run to form the means of transmission of the unwinding motion to the reels. A guide roll 116, coaxial with the axis of oscillation 113 of the arms 111, is driven in rotation by a belt 119 that is driven by a motor 121. The oscillatory movement of the arms 111 is imparted by a cylinder-piston actuator 123, while the tension of the belts 117 is controlled by an cylinder-piston actuator 125 carried by the arms 111, hinged at one end to said arms 111 and at the other end to auxiliary arms 112 carrying the transfer roll 114 and hinged around an axis of oscillation 112A carried by the arms 111. The tensioning of the belts 117 and the movement of the arms 111 are controlled using known methods and are not described.

A collection device 131 for empty reels can be moved along the tie beam 45, in the directions indicated by the double arrow f131. The collection device 131 has a vertically mobile cradle 133 which can move in the directions indicated by the double arrow f133 between two end positions shown in FIGS. 1A and 1B for discharging empty reels onto a conveyor 135 or other removal device. The collection device 131 and the respective cradle 133 also have a horizontal movement up to the position shown in FIG. 1K.

A pair of curved oscillating arms 139 is hinged on the tie beam 45, around an axis 137, parallel to the direction of translation of the shuttle 9. The opposite ends of the arms 139 in correspondence to those hinged on the tie beam 45, support a roll 141 (possibly motorized) destined to make contact with the web-like material to deviate the path thereof during the phases of changing a reel that has almost run out with a full reel, as will be described in detail further on. The curved arms 139 form a loop so as to encircle the axis of a reel that is running out.

On the side of unwinding station 7 outputting the web-like material, there is a guide roll 143 (see FIGS. 7A and 7B in particular), to which the web-like material unwound from the reel is transferred. The roll 143 can be idle or motorized. Along the path of the web-like material supplied from the unwinding station, downstream of the guide roll 143, a splicing device is provided, indicated generically and as a whole by reference 151, the function of which is that of splicing a web-like material coming from an almost empty reel to the web-like material coming from a new reel waiting and destined to substitute the one running out. The splicing device 151 includes a counter-pressure roll 153 with which rollers 155 and 157 of two respective ply-bonding groups 159 and 161 cooperate. The rollers 155 oscillate around an axis 163 parallel to the axis of the counter-pressure roll 153 and press against the latter under the effect of a pusher member consisting, in this example, of pressure bellows 165. The rollers 157 oscillate around an axis 167 under the force of the pressure bellows 169 or another pusher member. The ply-bonding groups 159 and 161 are known per se and operate in the known manner, and so do not require any additional description in this context.

An interruption member 171 is arranged above the splicing device 151 for cutting the web-like material coming from the reel that is running out after splicing with the web-like material coming from a new full reel. In the illustrated example, the interruption device 171 consists of a bar 173 carrying a toothed blade 175 and constrained by a pair of oscillating arms 177. The oscillation of the arms 177 around the axis of oscillation 179 is controlled by a cylinder-piston actuator 181.

The operation of the unwinder device that has been described up to this moment will now be illustrated with specific reference to the series of FIGS. 1A-1K. In FIG. 1A, the support formed by the two parallel arms 51 is in a raised position on the double upright 43, which will be indicated as the release position. The tailstock-carrier groups 79 associated with the two arms 51 are oriented in a manner such that the axes B-B of the tailstocks are located above the axis A-A of oscillation of the tailstock-carrier groups themselves. The pair of arms 49 forming the other reel support is situated in a lowered position on the double upright 41.

B1 indicates a first reel from which a first web-like material N1 is unwound for feeding a downstream production line, generically and summarily indicated by L. The position of the arms 49 is such that the reel being unwound B1 is slightly raised from the shuttle 9, which has been inserted in the space delimited by the uprights 41 and 43 to bring the reel B1 into the correct position for being grasped and raised by the arms 49 and by the tailstocks they carry. The surface unwinding member 110 is kept with its own belts 117 in pressure contact with the external surface of the reel B1 and the motor 121, driving the belts 117 in rotation, provokes the rotation and thus the unwinding of the reel B1 to supply the web-like material N1. The rotation can also be controlled in combination with the central unwinding member associated with the arms 49, i.e. via motor 99. This is particularly advantageous when the reel has a low density.

The collection device 131 is at the extreme left (in the drawing) of the tie beam 45, i.e. on the other side from where the web-like material is supplied to the processing line L. The cradle 133 of the collection device 131 is in the lower position, for releasing an empty reel, indicated by B0, onto the conveyor 135. The latter can be formed, for example, by a series of rubber wheels or the like.

Figure 1B:
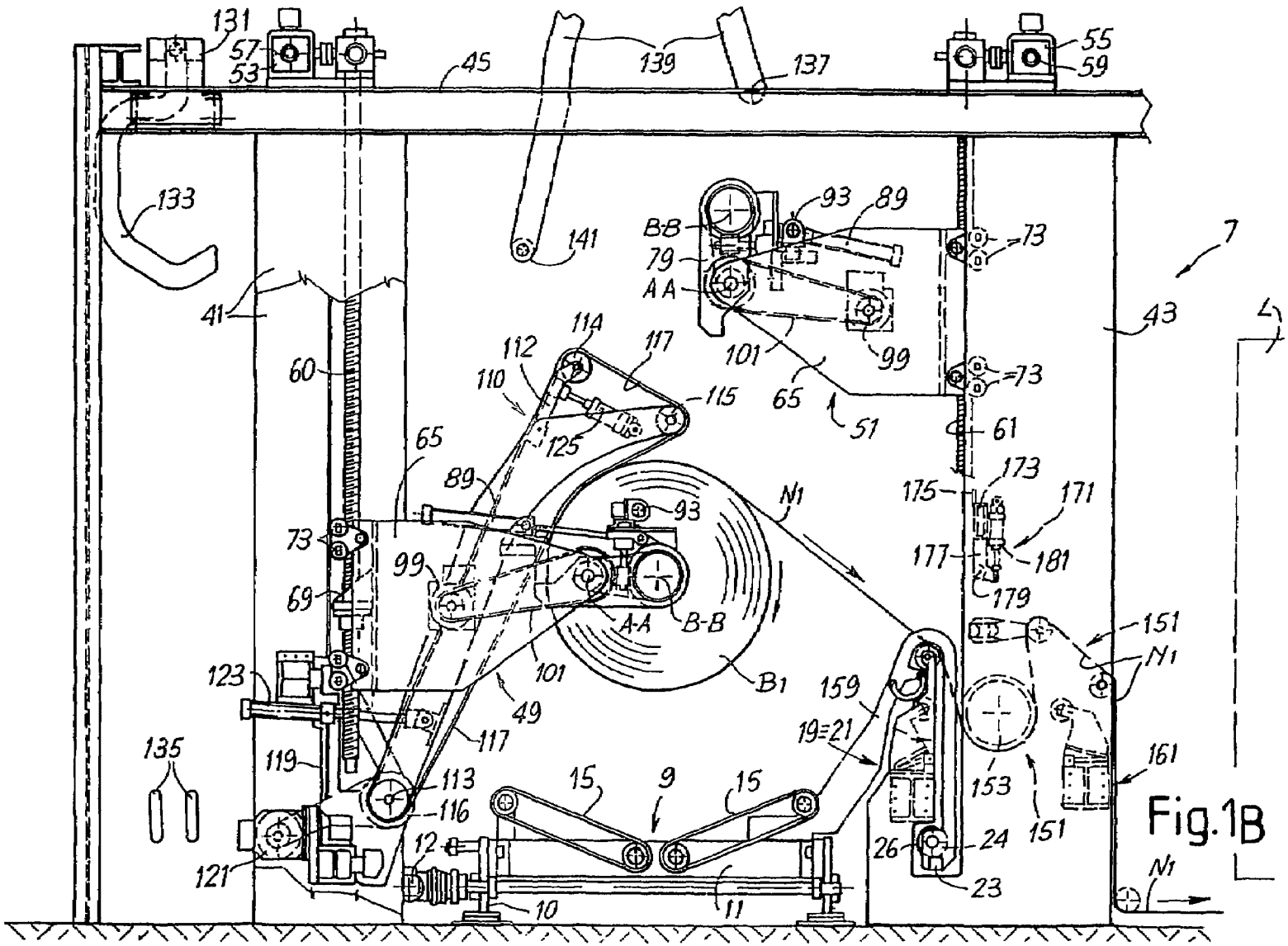
Figure 2:
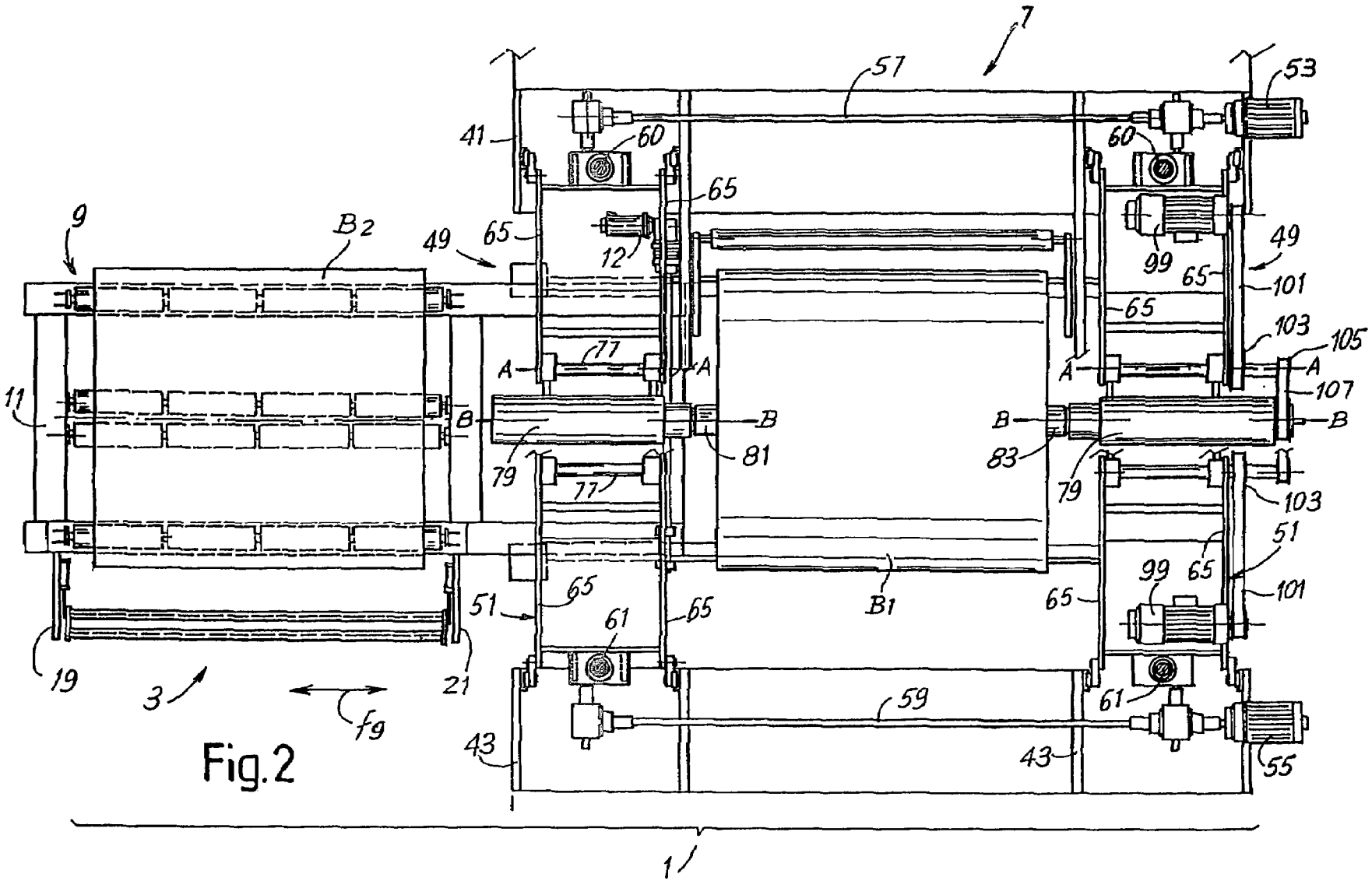
FIG. 2 shows a plan view, partially sectional along II-II of FIG. 1A, with parts removed, FIG. 3 show a lateral view, partially sectional along III-III of FIG. 4, of the shuttle separately from the unwinding station.

In FIG. 1B, the axis of reel B1 in the supply phase is still in the same position of FIG. 1A, i.e. in the position defined by the axis B-B of the tailstocks 81 and 83 of the support formed by the arms 49. The surface unwinding member 110 has rotated in a clockwise direction with respect to the previous figure in order to remain in contact with the reel and to continue to transmit the necessary torque for unwinding it. The curved arms 139 have rotated, with respect to the previous figure, in anticlockwise direction, while the cradle 133 of the collection device 131 has been brought to a raised position, directly beneath the tie beam 45.

In the unwinding phase illustrated in FIGS. 1A and 1B the torque for maintaining the reel B1 in rotation can be supplied solely by the surface unwinding member 110, or also in combination with the central unwinding member constituted by the motorized tail-stock 83. For example, in a known manner, torque could be applied via a surface unwinding system and also via a central unwinding system, these being coordinated to optimize the conditions of unwinding. For particularly small and/or particularly compact reels it is also possible to imagine using directly and exclusively the central unwinding system via the tailstock 83, thereby eliminating the surface unwinding member 110.

Already in this phase, the shuttle 9 that has brought the reel B1 to the unwinding station 7 can be transferred to the loading station 3, to receive a new reel which shall be inserted in the unwinding station in the successive cycle. It can thus be appreciated that the shuttle does not necessarily have to be a double one, as in traditional machines, although the possibility is not excluded. In the successive figures, the shuttle 9 is always shown in the same position, but it should be understood that it could have been removed from the unwinding station.

Figure 1C:
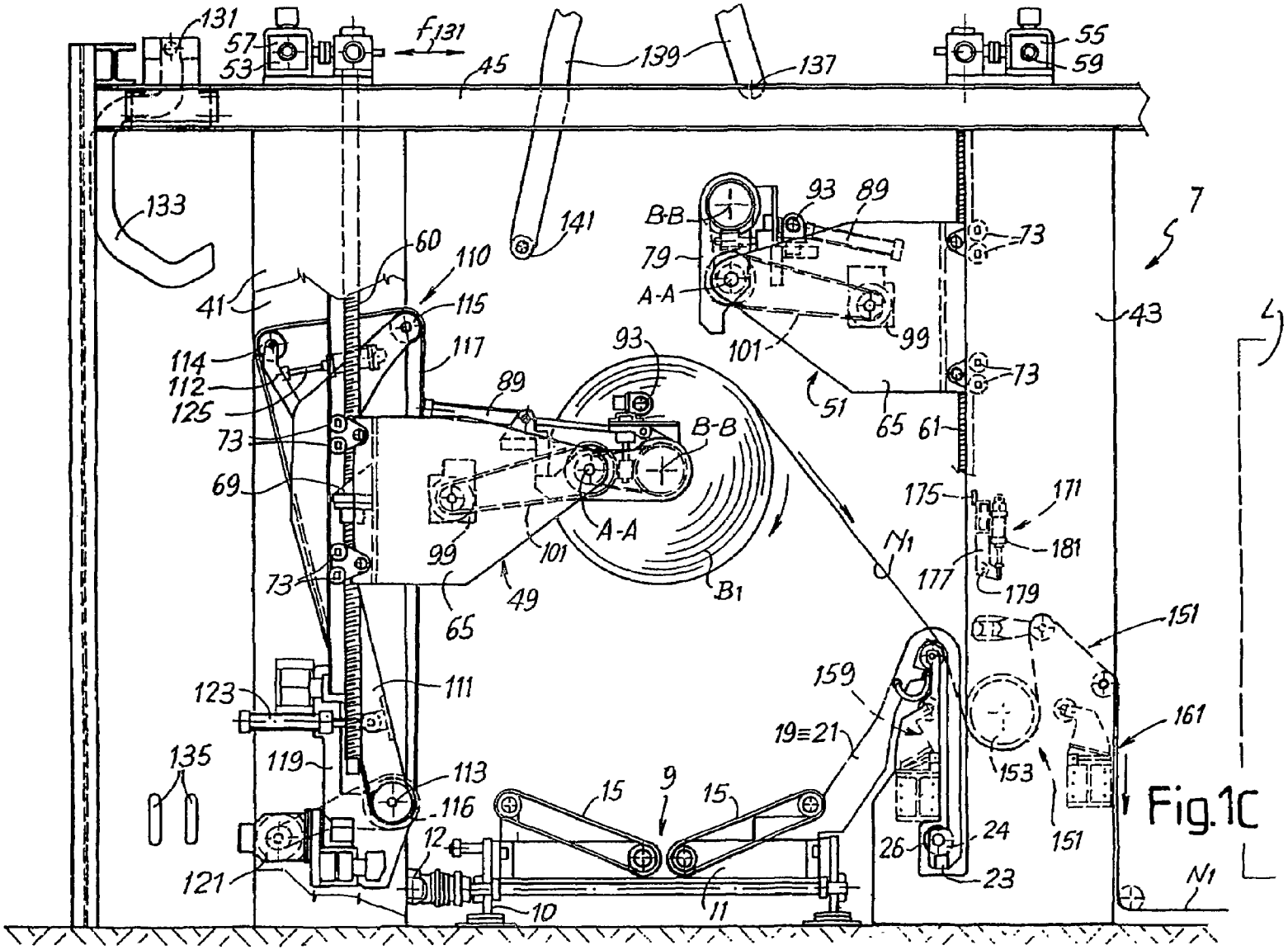

FIG. 1C shows the start of the phase of exchanging reel B1 that is running out with a new reel B2, which must be inserted by the shuttle 9. The insertion takes place with a translational movement of the shuttle 9 in the direction orthogonal to the plane of the figure. The surface unwinding member 110 has been made to swing in the anticlockwise direction to move it away from the reel B1. In this phase the reel B1 is kept in rotation only by the motorized tailstock 83, to continue supplying the web-like material N1 in a substantially continuous manner to the downstream production line. The pair of arms 49 has started to move upwards towards the tie beam 45.

Figure 1D:
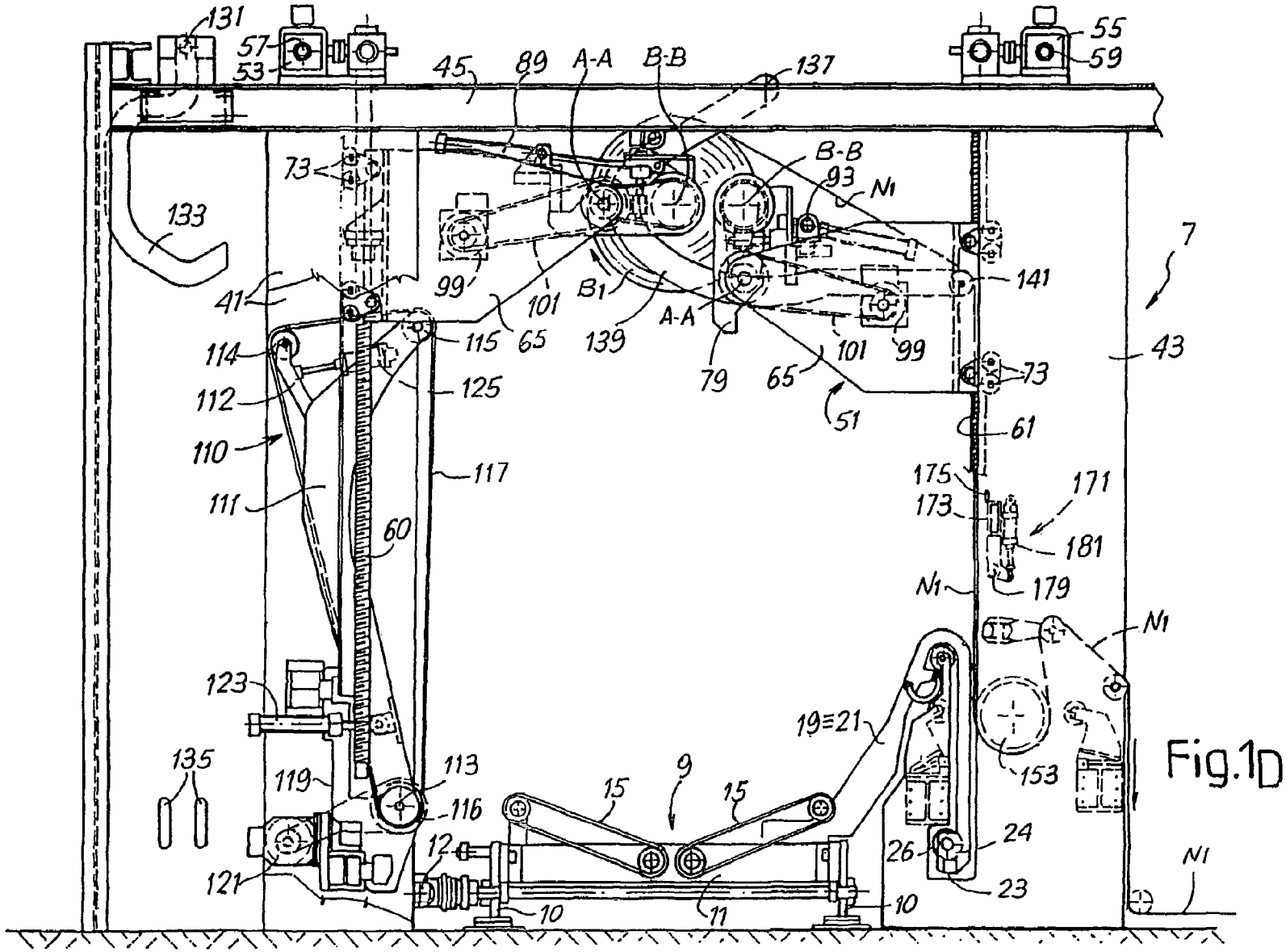

In the successive FIG. 1D the pair of arms 49 has reached the position of maximum lift, also designated as the release position, because in this position (after the web-like material wound on the reel B1 has run out) the tailstocks 81 and 83 will be extracted from the central axis of the empty reel to release it to the collection device 131. The pair of curved arms 139 has been rotated to bring it into the angular position illustrated in FIG. 1A. The distance between the two curved arms 139 is greater than the width of the web-like material wound on the reel so that they can be brought close to the axis of the reel itself. In this position, all of the space between the uprights 41 and 43 is free and the shuttle 9 can transit for inserting in this space a new reel destined to substitute the reel B1 in the phase of running out. In fact, the path of the web-like material N1 from the reel B1 to the transformation line has been deviated by the action of the oscillating curved arms 139, the function of which is exactly that of moving the web-like material being supplied away from the space in which a news reel must be inserted.

As can be seen in FIG. 1D, thanks to the fact that the tailstocks 81 and 83 of the pair of arms 51 are made to swing in an clockwise direction around the axis A-A to bring their axes B-B into vertical alignment above the axis A-A, the rising motion of the arms 49 does not cause collision between the tailstock of the two pairs of arms 49 and 51. The reel B1 does not collide with the tailstocks of the arms 51 as the latter are in an axially retracted position, i.e. at maximum reciprocal distance. In this position, the distance between the tailstocks is greater than the height, i.e. the axial length, of the reels handled by the unwinder device.

Figure 1E:
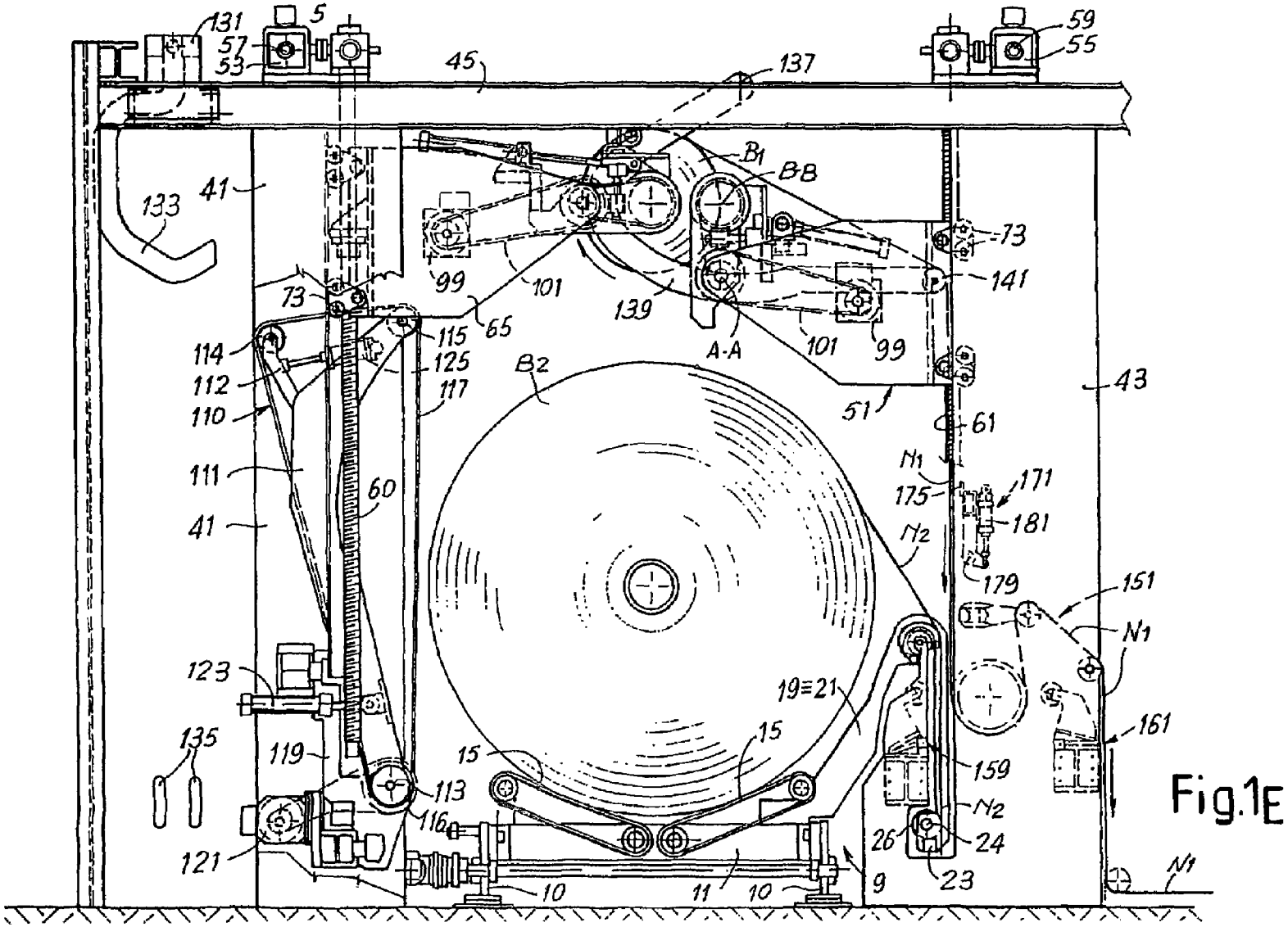

FIG. 1E shows the device in the same condition as the previous figure, but after the translation of the shuttle 9 that has brought a new reel, indicated by B2, between the uprights 41 and 43, and on which a second web-like material indicated by N2 is wound. The free leading or head edge of the web-like material N2 has been trimmed and prepared while the reel was in the loading station 5 or 3. As previously mentioned, for trimming the web-like material a bar 23 is provided that constitutes a guide for the cutting blade or other cutting tool used by the operator for creating a clean edge on the web-like material. This edge is then fixed to the roll 24. As mentioned, this can be a suction roll, for holding the free edge of web-like material. The semicircular members 27 and 29 are in the position shown in FIG. 1E in order to support the initial section of the web-like material above the fixed-axis guide roll 143. This permits the shuttle 9 to travel from the loading position to the unwinding position without the web-like material prepared on it interfering with the guide roll 143. Once the reel B2 has reached the position in FIG. 1E, the semicircular members 27 and 29 can be returned to the retracted position shown in FIG. 7A, so that the web-like material N2 rests on the guide roll 143.

Figure 1F:
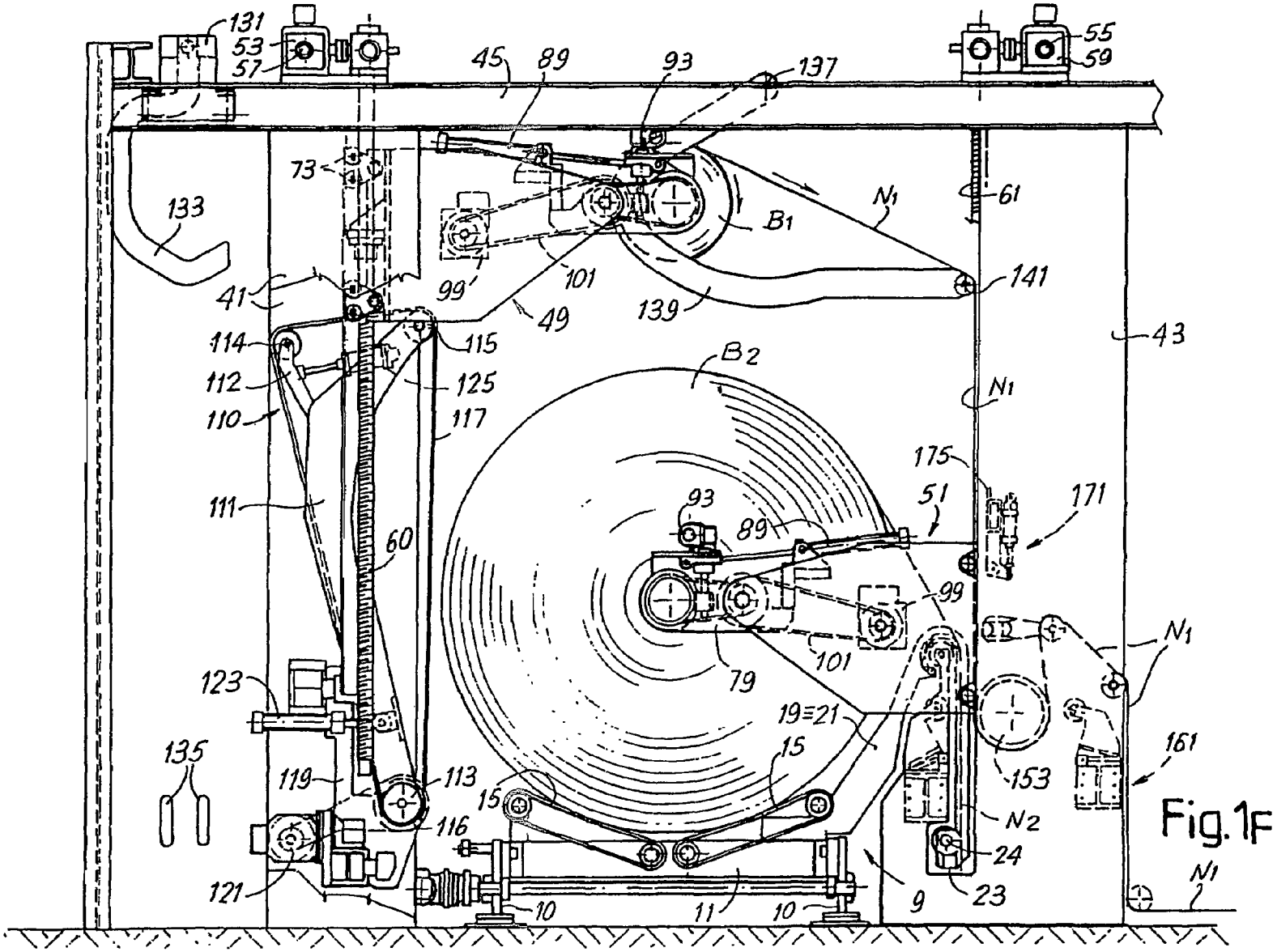

In the following FIG. 1F, the pair of arms 51, forming the second support for the reels in the unwinder device has been brought into the lower position on the uprights 43. This position is also called the engagement position, because it is the position in which the reel is engaged by the tailstocks. The tailstock-carrier groups 79 have been made to swing in the anticlockwise direction to bring the axes of the tailstocks 81 and 83 associated with the arms 51 into a position horizontally aligned with the axis A-A of oscillation of the tail-stock-carrier groups 79. In this condition, the axis B-B of the two tailstocks 81 and 83 carried by the arms 51 is in the same position in which the axes of the tailstocks 81 and 83 carried by the arms 49 were in the previous phase of taking the reel B1 from the shuttle 9. This allows just a translational movement to be given to the shuttle 9 in the direction orthogonal to the plane of the figure. Alternatively, if changing the geometric set-up of the tailstocks with respect to the arms 49 e 51 that carry them were not contemplated, it would be possible to arrange these arms at a reciprocal distance sufficient to avoid collisions, and give an additional translational movement to the reel insertions system, for example by equipping the shuttle 9 with a slide providing a movement orthogonal to the insertion and extraction direction of the shuttle 9 with respect to the unwinding station 7.

Figure 1G:
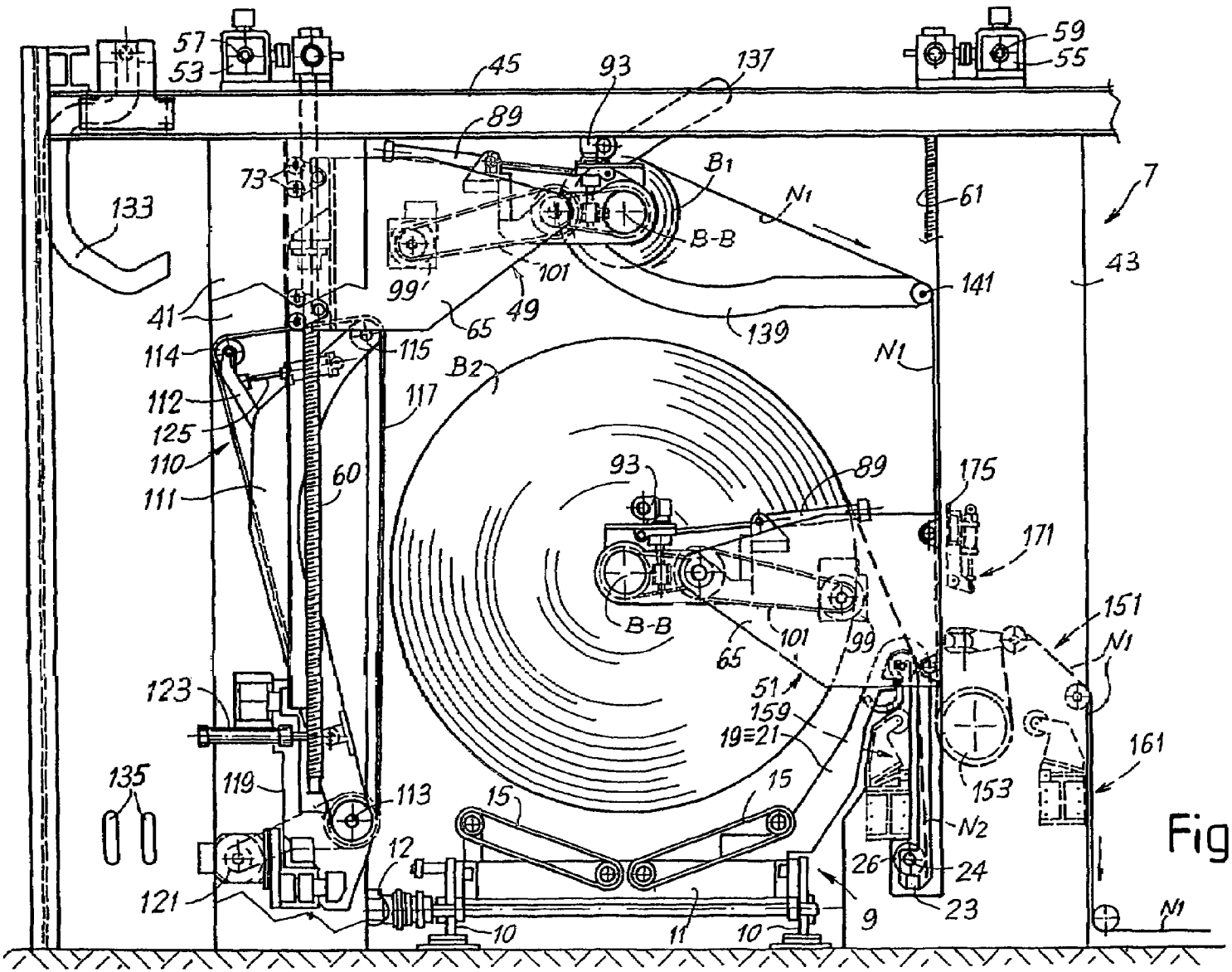

In FIG. 1G the pair of arms 51 has been slightly raised to bring the axis of the reel B2 into the same position assumed in FIG. 1A by the axis of reel B1. In this way, as reel B2 has lost contact with the support belts 15 provided on the shuttle 9, it is possible to start rotation of the reel B2.

Figure 1H:
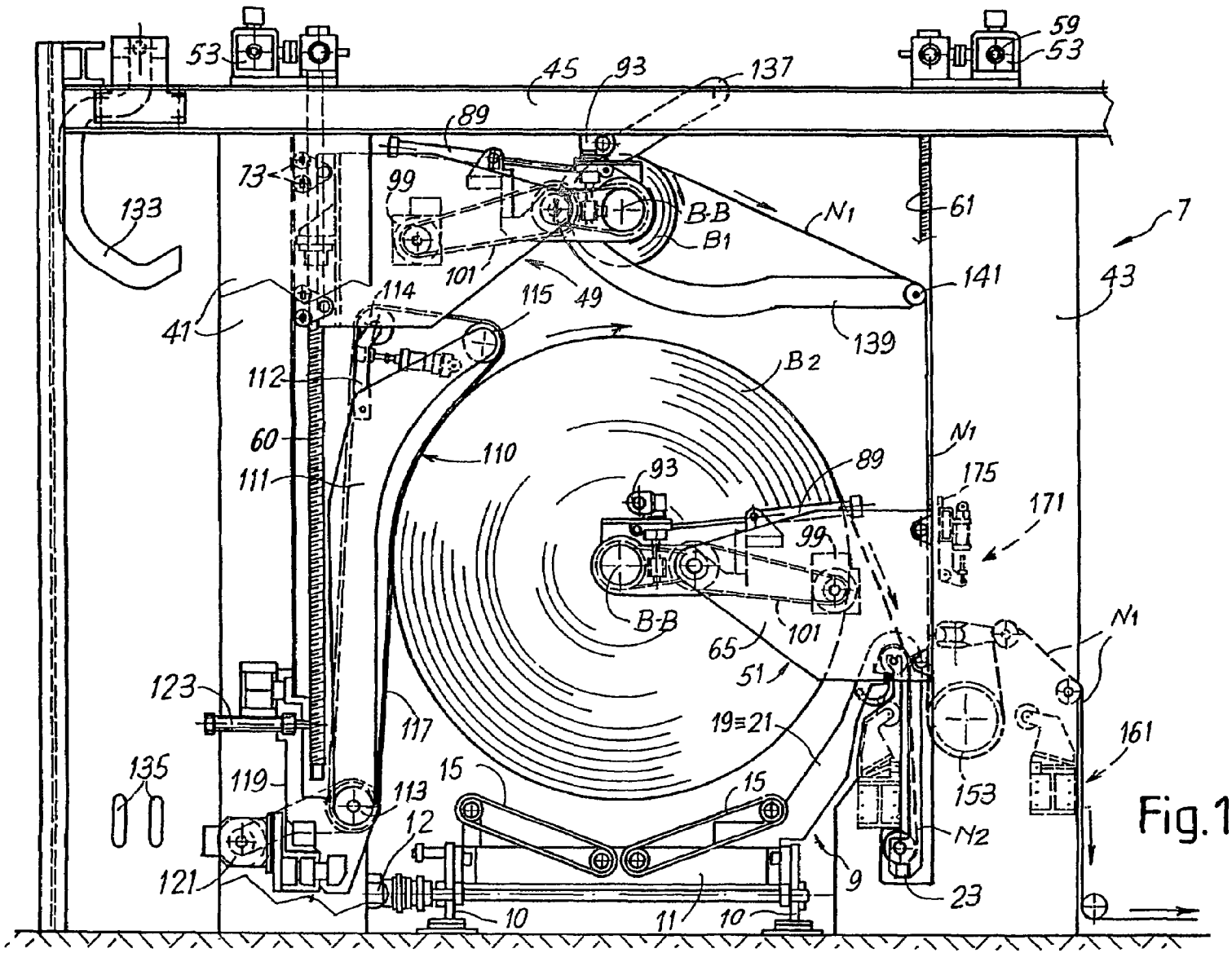

As can be seen in FIG. 1H, at this point the surface unwinding member 110 is made to swing in the clockwise direction to bring the belts 117 into contact with the outer cylindrical surface of the reel B2, to start the unwinding of the reel itself. The motor 121 is started with a suitable acceleration ramp and starts to make the reel B2 rotate. It is angularly accelerated until the speed of the web-like material N2 (and thus the peripheral speed of the reel) reaches the feed speed of the web-like material N1 coming from reel B1. The feed speed of the web-like material N1 can be temporarily reduced if appropriate.

The time necessary for bringing the peripheral speed of the second reel B2 up to the peripheral speed of the first reel B1 is relatively short. The web-like material N2 that is supplied by the reel B2 in this phase is collected around a motorized roll 24 to which the leading edge of the web-like material has, been attached beforehand. To that end, the motor 26 is operated, the speed of which is suitably controlled according to the peripheral speed of the reel B2. Before performing the splicing of the web-like material N2 with the web-like material N1, said two materials pass through the rollers 155 of the ply-bonding group 159 and the counter-pressure roll 153, which also serves as a guide and idle roll for the web-like material fed to the downstream production line, before these two elements are pressed against each other.

Figure 11:
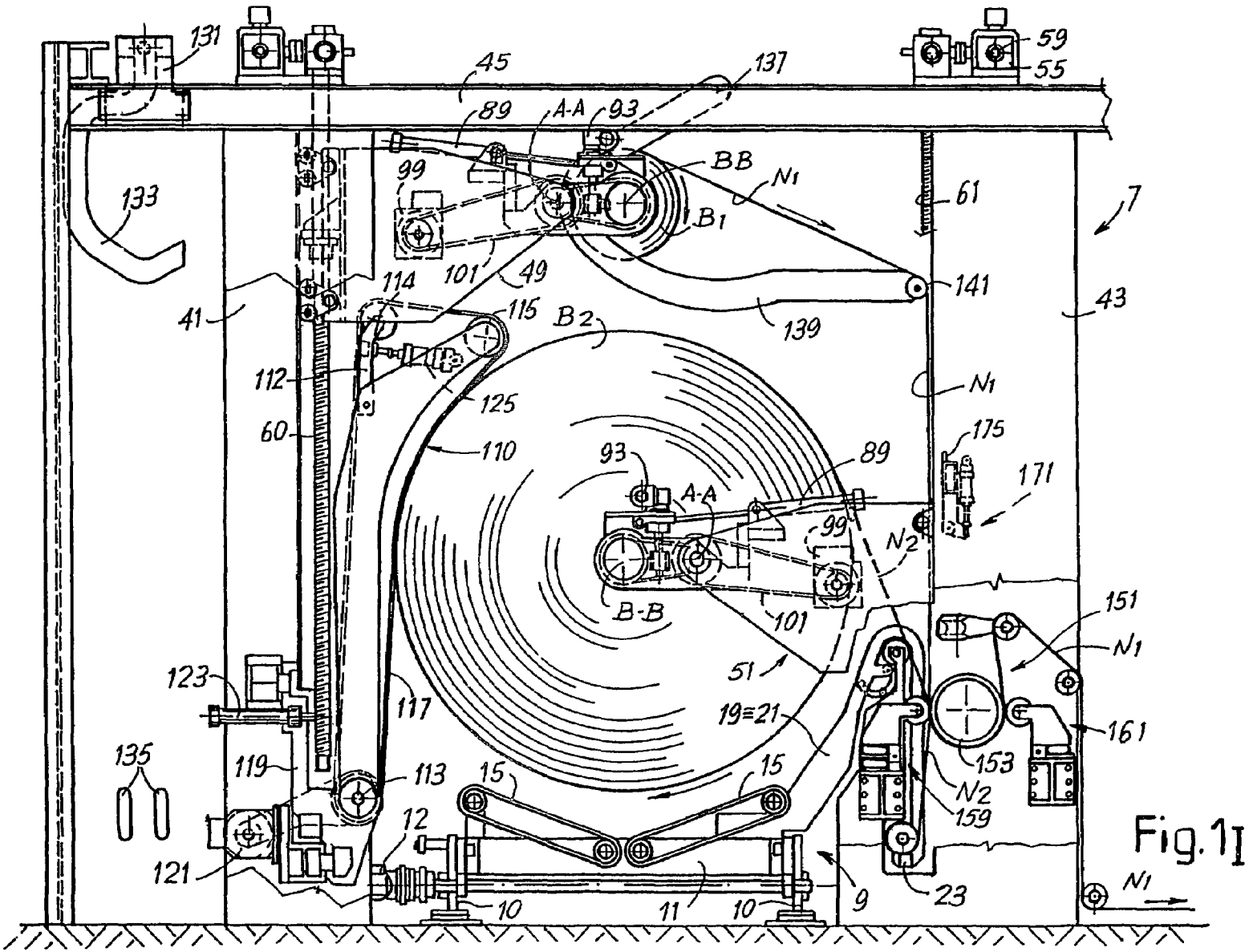

In the successive FIG. 11 the splicing phase of the web-like material N1 coming from the almost empty reel B1 with the web-like material N2 coming from the reel B2 is shown. To this end, the ply-bonding groups 159 and 161 are operated to bring the respective rollers 155 and 157 to press against the counter-pressure roll 153. The position taken by these members in this phase is illustrated in FIG. 7A. The two series of ply-bonding rollers 155 and 157 splice under pressure the two web-like materials, which are fed in parallel and at the same speed.

As part of the web-like material N2 was wound around the roll 24 during the phase of acceleration of the reel B2, to automatically retrieve this portion of web-like material, bonding groups it is possible to slow down and then invert the direction of rotation of the motor 26 and the roll 24 to output the head of the web-like material N2 to the transformation line L together with the web-like material N1 still in the phase of supply from the reel B1 and the web-like material N2 being unwound from the reel B2. This situation is shown in detail in FIG. 7B.

Figure 1J:
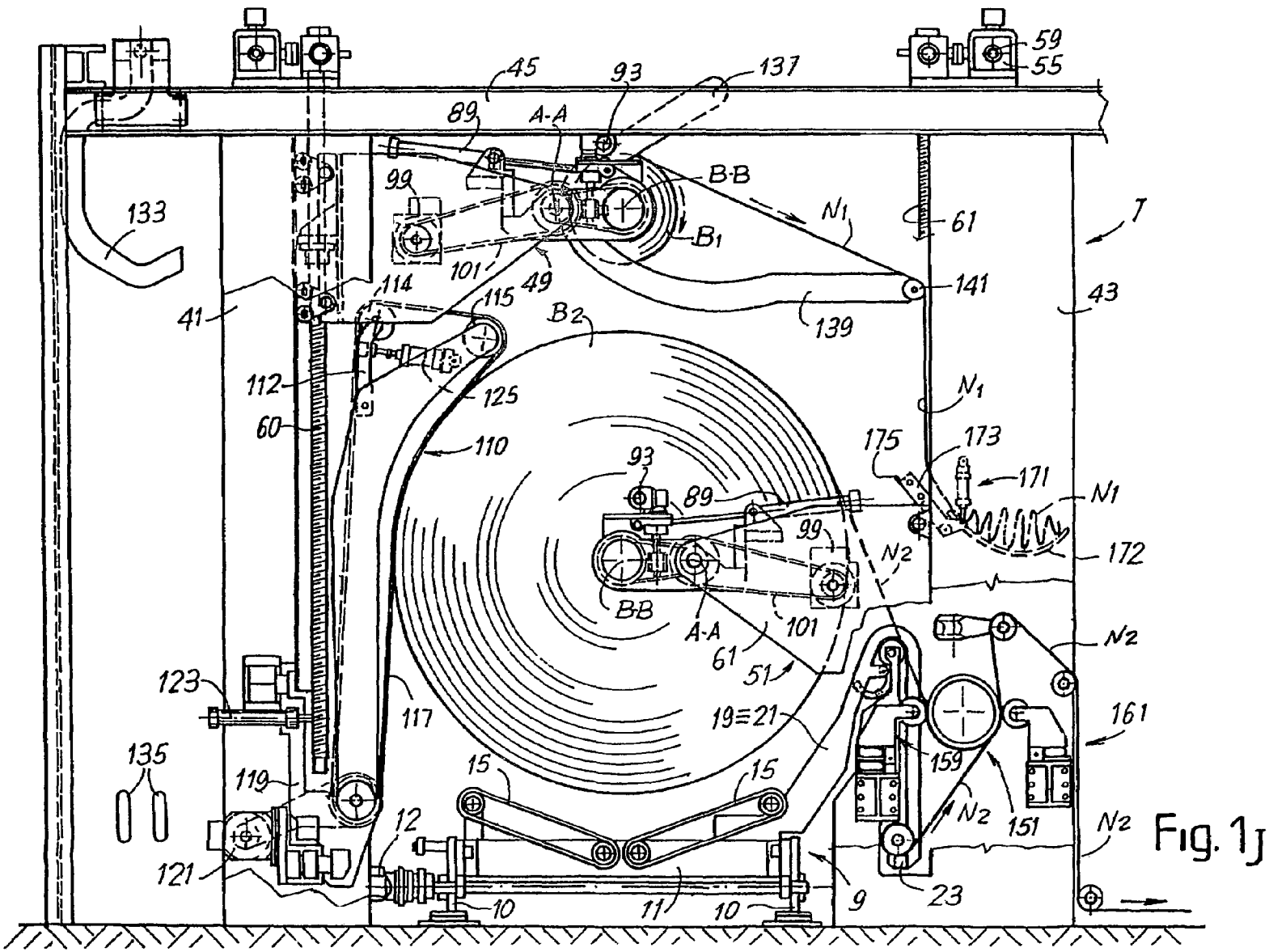

At a suitable moment in this phase of operation, the web-like material N1 coming from the first reel B1 is cut via the interruption member 171. The cutting or interruption phase of web-like material coming from the almost empty reel B1 is shown in FIG. 1J. After the start of the splicing operation and up to the passage of the tail of the web-like material N1 and the head of the material N2 through the splicing device 151, a material formed of three layers is fed from the splicing device 151, i.e. the web-like material N1 and the web-like material N2 doubled. After the passage of the head of the web-like material N2 that detaches itself from the roll 24 and the tail of the web-like material N1 through the nip formed by the counter-pressure roll 153 and the ply-bonding rollers 157, at the output of the splicing device 151 there will again be material composed of a single layer only, i.e. the web-like material N2, that starts the regular feed to the downstream converting line. The section in which the splice was formed will be discarded downstream by known systems and recycled.

Figure 1K:
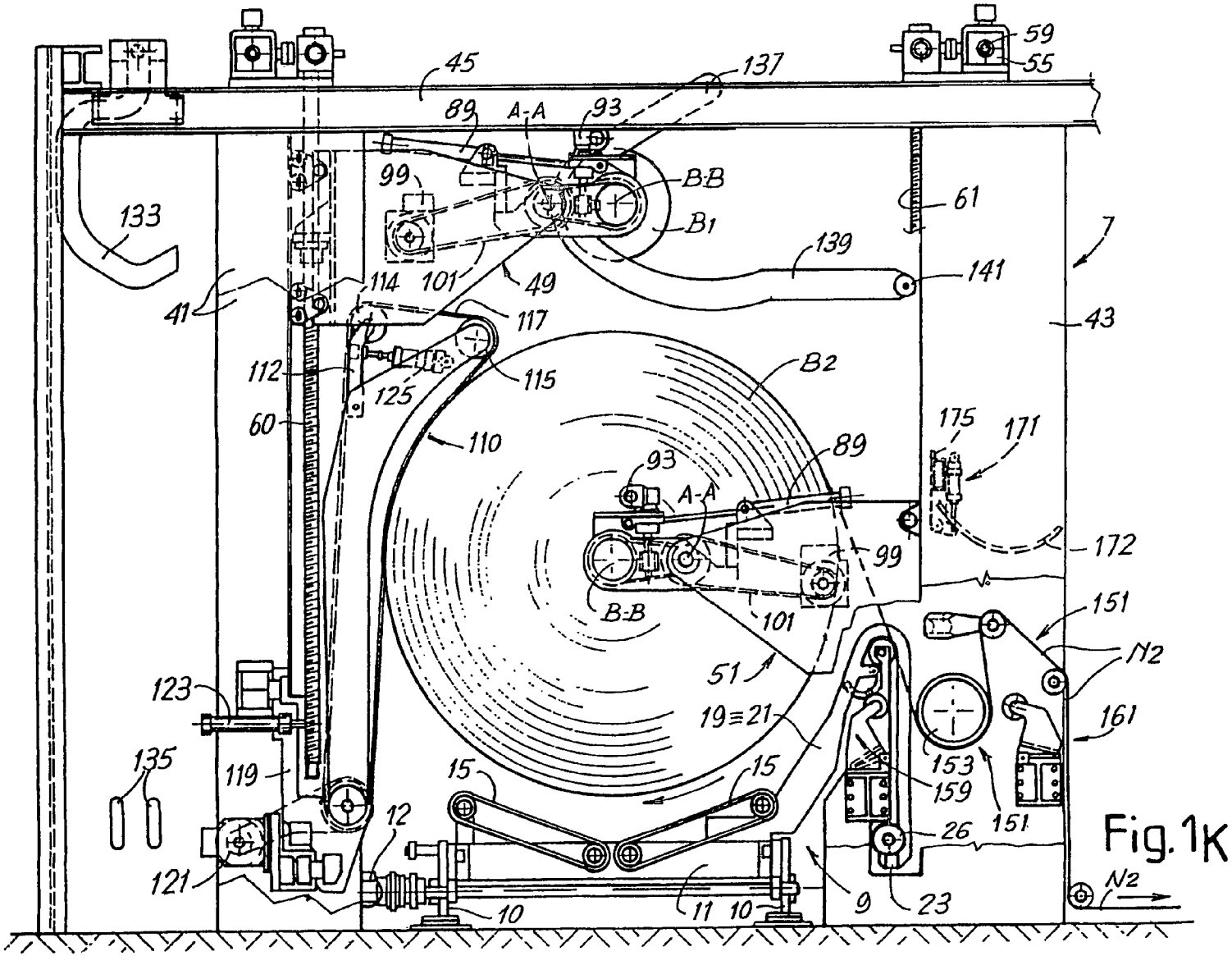

In the successive FIG. 1K it is shown how the collection device 131 retrieves the empty reel B1 that is released by the tailstocks 81 and 83 on the cradle 133. The collection device then moves to a position similar to that in FIG. 1A, with the cradle 133 in the low position for discharging the residue of the reel B1.

As can be seen comparing FIGS. 1A and 1K, the supply of the web-like material N2 continues with the unwinder device in a setup substantially symmetrical to that shown in FIG. 1A. When the reel B2 runs out, the device will perform a substitution cycle substantially symmetrical to that described, where the arms 49 and 51, with the respective members that they carry, will perform partially inverted operations with respect to that described above.

From the above, it will be appreciated that the above-described unwinder device is capable of performing the substitution of an almost empty reel with a new reel and splicing the web-like material coming from the almost empty reel with the web-like material coming from the new reel without halting supply to the downstream production line and also retrieve all of the web-like material unwound from the new reel during the splicing phase, for simplifying the recycling operations. No residues of web-like material remain on the shuttle 9. The portion of web-like material N1 partially unwound from the emptied reel B1 (between this and the interruption device 171), is recovered around the tubular core of the reel B1 by inverting the direction of rotation of the tailstock 83 of the respective pair of arms 51, such that it cannot hamper unloading operations.

As the reel B1 that is running out must be slowed down until it stops after the cutting of the web-like material N1 has been performed, this continues to be unwound for a certain length until the direction of rotation of the reel B1 is inverted to permit its retrieval. To avoid this residual portion of web-like material N1 interfering with other members of the machine, and in particular with the members of the splicing device, a collection element is advantageously provided, in the form of a curved surface 172 or other system of containment.

The usage of two ply-bonding groups 159 and 161 as described above ensures that on the portion of material where the splice is made between the web-like materials N1 and N2 there are no free edges that can hamper the feeding of the material itself. In fact, when the first ply-bonding group 159 closes to make the splice, a ply-bonding spliced zone between the two web-like materials N1 and N2 starts to be created. Without the second ply-bonding group 161, the portion of web-like material temporarily accumulated on the roll 24 would simply be dragged by the material after splicing, remaining free with the risk of running astray. The presence of the second ply-bonding group makes sure that this portion of web-like material N2, is caused to adhere by ply-bonding to the material that advances in a controlled and not a free manner to the downstream converting line L. The second ply-bonding group also guarantees a more reliable splicing of the layers, exerting sufficient traction on the portion of material temporarily wound and accumulated on the roll 24, to facilitate retrieval.

The particular arrangement of the roll 24 for the temporary accumulation of the web-like material N2 coming from the reel B2 downstream of the position of the first ply-bonding group 159, i.e. of the zone in which the web-like materials N1 and N2 are spliced, allows the second reel B2 to be accelerated significantly before performing the splicing, and thus essentially of not excessively reducing the feed speed of the web-like material. At the same time, contrary to known devices, it is not necessary to have a large distance between the splicing members and the position of the reels being unwound. As can be observed in the drawings, the splicing occurs in a position very close to the reels and this permits better control of the web-like material and greater compactness of the production line.

From that described above, it is also clear that one of the advantages of the device in this embodiment is represented by the possibility of retrieving, without manual intervention, the head of the web-like material of the new reel that will substitute the empty reel. This requires the utilization of the motorized roll 26.

Figure 8B:
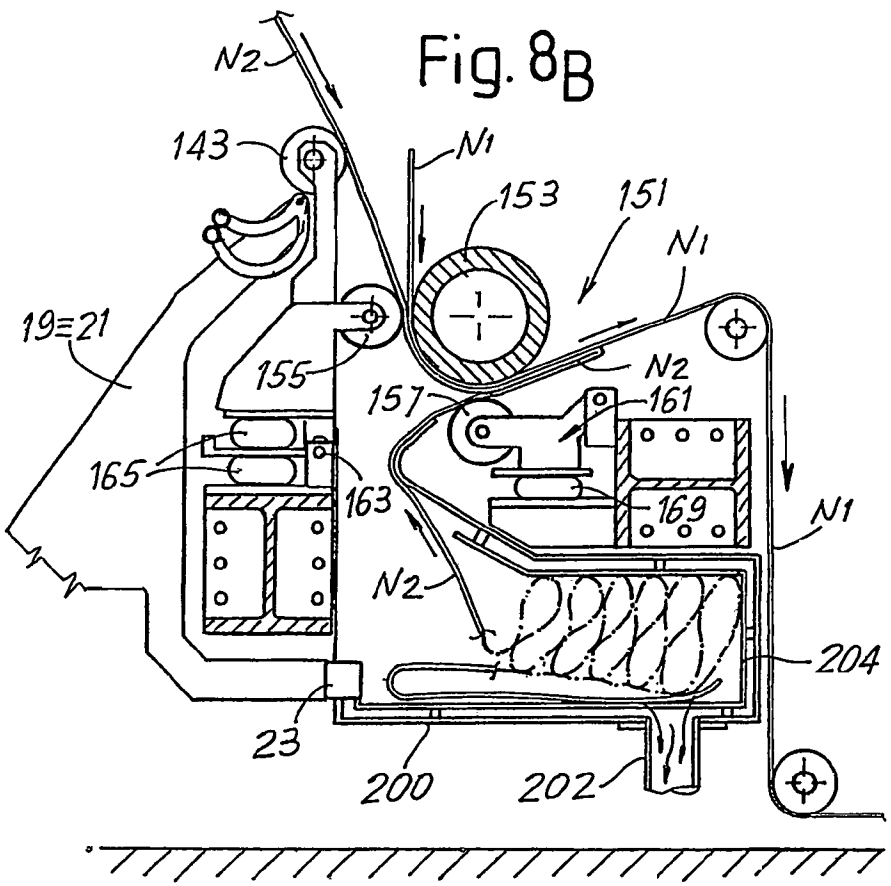
FIGS. 8A and 8B show an enlarged schematic lateral view of a modified embodiment for the accumulator member in two different conditions.
Figure 8A:
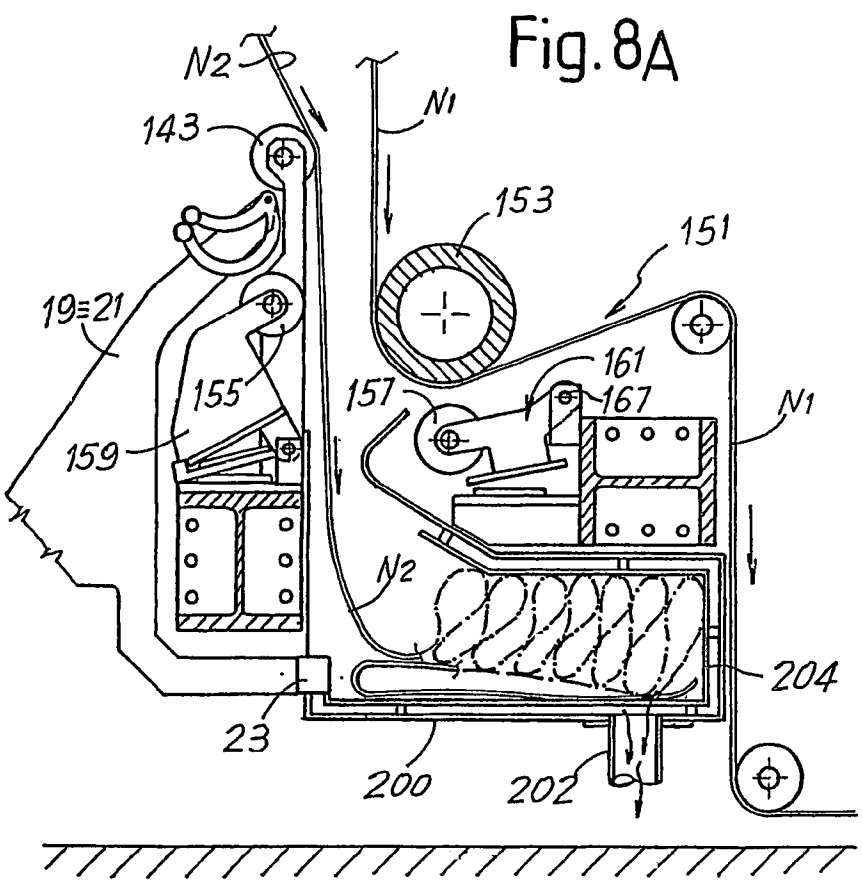

However, other configurations are also possible for realizing an accumulation member for the initial portion of web-like material coming from the new reel. An alternative configuration is illustrated in FIGS. 8A and 8B. The same or equivalent parts to those of the previous figures (in particular FIGS. 7A and 7B) are indicated with the same reference numbers. In this case, the roll 24 and the respective motor 26 are absent and the bar 23 is hollow and equipped with suction slots or holes that hold the head of the web-like material N2 in the preparation phase until the respective reel B2 is inserted inside the unwinding station 7.

During the acceleration phase of the reel B2, the initial portion of web-like material N2 is sucked inside a chamber 200 provided in the unwinding station 7. Thanks to a suction-pipe 202, the pressure inside the chamber 200 is slightly less than that of the atmosphere. Suction through the hollow bar 23 is interrupted. The web-like material that in the previous example of embodiment was wound around the roll 24 thus accumulates in the chamber 200. To avoid the web-like material-that accumulates in the suction chamber 200 from obstructing the suction, a basket 204 is placed inside the chamber to hold the web-like material.

Once the splicing of the two web-like materials is completed, the suction inside the chamber 200 can be interrupted and all of the material that has accumulated is retrieved as shown in FIG. 8B in a similar manner to that previously described for the material temporarily wound, ground the roll 24.

With this arrangement, or with that which uses the roll 24, a temporary accumulation of web-like material is realized, which will subsequently be fed to the production line, and included on the roll containing the splice between the two layers. This roll is destined, in any case, to be recycled. In this way, the need to remove web-like material dross from the unwinding station 7 or the shuttle 9 by hand or with other systems is avoided.

It is understood that the drawings only show possible embodiments of the invention, which can vary in form and arrangement without however departing from the scope of the concept underlying the invention. Any reference numbers in the attached claims are provided only in order to facilitate the reading of the claims reference being made to the foregoing description and the enclosed drawings, and do not limit the scope of protection of the claims.

The invention claim is:

1. An unwinder device for unwinding reels of web material comprising an unwinding station with unwinding members for unwinding said reels and a splicing device for splicing together web materials coming from a first reel and from a second reel, wherein in said unwinding station at least two supports are arranged for respective reels of web material; each support is associated with a respective one of said unwinding members which supply rotary motion to a reel placed on a respective support of said supports, said supports being constructed and arranged to simultaneously support two reels being unwound, during at least one phase of unwinding, and each of said supports being arranged and constructed for loading a new reel in an engagement position, supporting the new reel during unwinding and discharging an expired reel in a release position; wherein the splicing device is arranged and controlled for splicing together a first web material unwound from the first reel carried by a first support of said supports and a second web material unwound from the second reel carried by a second support of said supports when peripheral speeds of said first reel and said second reel are substantially common; and wherein each support of said supports being moveable in a vertical direction from said engagement position to said release position, said release position being above said engagement position.

2. An unwinder according to claim 1, wherein said vertical movement of each said support is controlled by a respective motor.

3. An unwinder device according to claim 1, wherein said engagement position and said release position are mutually distinct.

4. An unwinder device according to claim 1, further comprising a shuttle mobile along a direction of translation between at least one loading station and said unwinding station.

5. An unwinder device according to claim 4, wherein said shuttle carries members for support of a single reel and moves between a single loading station and said unwinding station in a direction parallel to an axis of the reels.

6. An unwinder device according to claim 4, wherein said at least two supports are designed and controlled to be both brought into a common engagement position, said shuttle being arranged and controlled to transfer each reel to the common position inside the unwinding station, independently of which the at least two supports is destined to engage.

7. An unwinder device according to claim 4, wherein said shuttle includes at least one retainer member for a free leading edge of web material of a respective reel positioned on said shuttle.

8. An unwinder device according to claim 7, wherein in said unwinding station a guide roll for web material is arranged, an axis of the guide roll being parallel to the direction of translation of said shuttle, and wherein on said shuttle a path is defined for an initial portion of said web material extending from said retainer member to the reel, which passes over a position of the axis of said guide roll.

9. An unwinder device according to claims 7, wherein said retainer member is a suction member.

10. An unwinder device according to claim 7, wherein said retainer member is associated with said motorized roll.

11. An unwinder device according to claim 1, wherein said unwinding members and the supports are controlled in a manner such that while the unwinding members associated with the first support of said at least two supports maintain the first reel of the first web material in rotation in a supply phase, the second reel of the second web material being engaged by the second support and made to rotate.

12. An unwinder device according to claim 1, wherein said engagement position of said each support of said supports engages the reel by said supports and a main unwinding position, distinct from the engagement position, in correspondence of which a major part of unwinding of the reel takes place.

13. An unwinder device according to claim 1, further comprising at least one accumulator member for accumulating the second web material supplied by said second reel before the second web material is spliced to said first web material.

14. An unwinder device according to claim 13, wherein said accumulator member is reversible and returns accumulated web material after splicing between the first web material and the second web material.

15. An unwinder device according to claims 13, wherein said accumulator member is carried by a shuttle mobile along a direction of translation between at least one loading station and said unwinding station.

16. An unwinder device according to claim 13, wherein said accumulator member includes at least one roll to which a free leading edge of said second web material is anchored, the second web material winding itself around said roll when the second reel is made to rotate and before the second web material is spliced to the first web material.

17. An unwinder device according to claim 16, wherein said roll is motorized.

18. An unwinder device according to claim 16, wherein said roll is a suction roller.

19. An unwinder device according to claim 13, wherein said accumulator member includes a suction chamber.

20. An unwinder device according to claim 13, wherein said accumulator member is permanently arranged in the unwinding station.

21. An unwinder device according to claim 13, wherein during splicing of the first web material and the second web material, said accumulator member is downstream of an initial splicing zone between said first web material and the second web material with respect to a feed direction of said first web material and said second web material.

22. An unwinder device according to claim 1, wherein said unwinding members include for each support of said at least two supports a central unwinding member which provides rotational motion to a respective reel.

23. An unwinder device according to claim 1, wherein in said unwinding stations a surface unwinding member is arranged.

24. An unwinder device according to claim 23, wherein said unwinding members associated with said supports and said surface unwinding member are arranged and controlled in such a way that while the first reel in output and supported by the first support of said supports is maintained in rotation by the unwinding members associated with said first support, said surface unwinding member and/or a central unwinding member of the second support of said supports start to rotate the second reel carried by the second support.

25. An unwinder device according to claim 1, wherein said at least two supports each include at least one arm which is mobile from said engagement position to said release position, the arms having a geometric configuration which is changeable to permit said two supports to exchange positions.

26. An unwinder device according to claim 25, wherein each arm of said at least two supports includes a main body and an end that is mobile with respect to said main body and carries a gripper device for a respective reel.

27. An unwinder device according to claim 26, wherein said each arm and the gripper device thereof are constructed and arranged such that in said engagement position the gripper device of the arm of said at least two supports are aligned in a common position for gripping the respective reel, corresponding to a position of an axis of each reel transported by a shuttle in said unwinding station.

28. An unwinder device according to claim 26, wherein said end which is mobile of said each support oscillates with respect to the main body of the arm between an extracted position for gripping the respective reel and a retracted position.

29. An unwinder device according to claim 25, wherein each said gripper device includes at least one tailstock.

30. An unwinder device according to claim 29, wherein said at least one tailstock for each of said at least two supports is motorized.

31. An unwinder device according to claim 29, wherein said at least one tailstock is provided with an axial insertion and extraction movement on the respective reel.

32. An unwinder device according to claim 1, wherein each of said at least two supports includes a pair of parallel arms, each arm being equipped with a gripper device for the respective reel.

33. An unwinder device according to claim 1 further comprising a deviator member in said unwinding station which deviates a path of the first web material supplied by the first reel when supplied to permit the second reel to be inserted in said unwinding station.

34. An unwinder device according to claim 33, wherein in said unwinding station two uprights are arranged along which said at least two supports can move, a space between the two uprights for passage of a shuttle being provided.

35. An unwinder device according to claim 34, wherein said two uprights are connected by a tie beam and wherein said deviator member is oscillatingly hinged to said tie beam.

36. An unwinder device according to claim 33, wherein said deviator member includes a curved oscillating arm, hinged at one end to an axis of oscillation and with an opposite end contacting web material to deviate the path of the web material, and wherein between said one end and said opposite end the arm forms a loop that surrounds an axis of the reel, the web material of which is deviated by said oscillating arm.

37. An unwinder device according to claim 36, wherein said deviator member includes a pair of arms between which a contact roller for the web material is supported.

38. An unwinder device according to claim 37, wherein said contact roller is motorized.

39. An unwinder device according to claim 1, wherein in said unwinding station a collection device is provided for collecting and discharging empty reels alternately between one and another of said at least two supports.

40. An unwinder device according to claim 39, wherein said collection device is mobile along a tie beam arranged between two uprights.

41. An unwinder device according to claim 39, wherein said collection device includes a cradle on which empty reels are deposited.

42. An unwinder device according to claim 41, wherein said cradle is provided with a vertical motion for discharging empty reels onto a conveyor.

43. An unwinder device according to claim 1, wherein in said unwinding station a web material interruption member is arranged.

44. An unwinder device according to claim 1, wherein said splicing device is double.

45. An unwinder device according to claim 44, wherein said splicing device includes two ply-bonding groups arranged in series along a path of the web material.

46. A method for continuously feeding a web material from reels being unwound to a processing line comprising:

placing a first reel in a loading position, engaging said first reel on a first support associated with a first unwinding member which brings and keeps said first reel in rotation, supplying a first web material from said first reel to the processing line, moving along a vertical direction said first support and said first reel from said loading position towards an unloading position distinct from said loading position and arranged above said loading position;

when said first reel has been removed from said loading position, placing a second reel with a second web material in said loading position, engaging said second reel on a second support associated with a second unwinding member, making said second reel rotate by means of said second unwinding member and unwinding an initial portion of the second web material from the second reel, splicing together the first web material and the second web material unwound from said first reel and said second reel when peripheral speed of said first reel and said second reel are substantially common, said first web material and said second web material being brought into reciprocal contact when said first reel and said second reel rotate at peripheral speeds that are substantially common;

when said first web material has been spliced to said second web material, unloading said first reel from the first support, and moving along a vertical direction said second support towards the unloading position and bringing back said first support to said loading position for engaging a successive reel.

47. A method according to claim 46, further comprising transferring said first reel from the loading position to a main unwinding position and from said main unwinding position to said unloading position.

48. A method according to claim 46, wherein said initial portion of the second web material is accumulated by an accumulator member.

49. A method according to claim 48, wherein said initial portion of the second web material is temporarily accumulated and subsequently retrieved, supplying the second web material to said processing line.

50. A method according to claim 49, further comprising arranging two ply-bonding devices in series, for splicing together said first web material and said second web material; and bonding the temporarily accumulated and subsequently retrieved initial portion of the second web material to the web material being fed to the processing line.

51. A method according to claim 48, wherein said initial portion of web material is accumulated in a position downstream, with respect to a feed direction, of the position in which the first web material and the second web material are brought into reciprocal contact for splicing.

52. A method according to claim 46, wherein said first unwinding member and the second unwinding member are central unwinding members.

53. A method according to claim 46, wherein said second reel is made to rotate via a surface unwinding member and/or via said second unwinding member associated with the second support, while said first reel is maintained in rotation by the first unwinding member associated with the first support.

54. A method according to claim 46, wherein said first web material and said second web material are spliced by ply-bonding.

55. A method according to claim 46, wherein said first web material and said second web material are spliced in two distinct points along a feed path therefor.

* * * * *